US005192652A

United States Patent [19]

Kajiwara et al.

[11] Patent Number: 5,192,652

[45] Date of Patent: * Mar. 9, 1993

[54] SILVER HALIDE LIGHT-SENSITIVE PHOTOGRAPHIC MATERIAL

[75] Inventors: Makoto Kajiwara; Masanobu Miyoshi, both of Odawara, Japan

[73] Assignee: Konica Corporation, Kanagawa, Japan

[ * ] Notice: The portion of the term of this patent subsequent to Apr. 3, 2007 has been disclaimed.

[21] Appl. No.: 723,677

[22] Filed: Jun. 27, 1991

Related U.S. Application Data

[63] Continuation of Ser. No. 527,702, May 24, 1990, abandoned, which is a continuation of Ser. No. 299,369, Jan. 23, 1989, abandoned.

[30] Foreign Application Priority Data

Jan. 30, 1988 [JP] Japan ..... 63-20364

[51] Int. Cl.[5] ..... G03C 1/34; G03C 7/32

[52] U.S. Cl. ..... 430/551; 430/558; 430/603; 430/608; 430/614; 430/600

[58] Field of Search ..... 430/551, 558, 603, 608, 430/600, 614

[56] References Cited

U.S. PATENT DOCUMENTS

| | | | |
|---|---|---|---|
| 3,189,458 | 6/1965 | Herz | 430/600 |
| 3,725,067 | 4/1973 | Bailey et al. | 430/558 |
| 4,524,132 | 6/1985 | Aoki et al. | 430/552 |
| 4,748,100 | 5/1988 | Umemoto et al. | 430/505 |
| 4,752,561 | 6/1988 | Nishijima et al. | 430/551 |

FOREIGN PATENT DOCUMENTS

| | | |
|---|---|---|
| 232624 | 8/1987 | European Pat. Off. . |
| 297804 | 1/1989 | European Pat. Off. . |

*Primary Examiner*—Charles L. Bowers, Jr.
*Assistant Examiner*—Janet C. Baxter
*Attorney, Agent, or Firm*—Finnegan, Henderson, Farabow, Garrett and Dunner

[57] ABSTRACT

A light-sensitive silver halide photographic material comprising a support and provided thereon at least one silver halide emulsion layer containing a pyrazolo azole magenta dye-forming coupler represented by general formula M-I;

M-1

(wherein Z represents a group of non-metallic atoms necessary to complete a nitrogen-containing heterocyclic ring which may have a substituent; X represents a hydrogen atom or a substituent capable of being split off upon reaction with an oxidation product of a color developing agent; and R represents a hydrogen atom or a substituent), to said silver halide emulsion layer an elementary sulfur having been added at an arbitrary timing before the formation of said silver halide emulsion layer on said support.

21 Claims, No Drawings

SILVER HALIDE LIGHT-SENSITIVE PHOTOGRAPHIC MATERIAL

This application is a continuation of application Ser. No. 07/527,702 filed May 24, 1990, now abandoned, which is a continuation of application Ser. No. 07/299,369 filed Jan. 23, 1989, now abandoned.

FIELD OF THE INVENTION

The present invention relates to a silver halide light-sensitive color photographic material, in particular, to a silver halide light-sensitive color photographic material capable of eliminating stain caused by moisture, heat or light, and with which the illumination dependency of its resultant gradation is significantly limited.

BACKGROUND OF THE INVENTION

When a dye image is formed using a silver halide light-sensitive color photographic material, an aromatic primary amine color developing agent is oxidated when it reduces silver halide in an exposed light-sensitive silver halide color photographic material, thereby the resultant oxidation product reacts with a coupler preliminarily contained in the light-sensitive silver halide color photographic material so as to form a dye. Usually, in such an image forming system, a color reproduction technique based on the subtractive color process is used, wherein the light-sensitive silver halide color photographic material used comprises the blue-sensitive, green-sensitive, and red-sensitive silver halide emulsion layers correspondingly have yellow-dye forming, magenta-dye forming, and cyan-dye forming couplers, i.e. couplers whose sensitivities complementary to the color sensitivities of these emulsion layers.

The couplers useful for forming the yellow dye image include acylacetanilide couplers; and the couplers useful for forming the magenta dye image include pyrazolone, pyrazolobenzimidazole, pyrazolotriazole, and indazolone couplers; while the examples of the commonly used cyan dye image forming couplers include phenol and naphthol couplers.

The so-obtained image is required to be stable even when exposed to light for a long time, or even when stored under a high temperature or high humidity. Especially, a silver halide color photographic light-sensitive material (hereinafter referred to as color photographic material) which does not cause yellow stain (hereinafter referred to as Y-stain) in the nondye-image portion has been a long-felt demand in the art.

As compared with the yellow and cyan couplers magenta couplers are liable to cause more significant Y-stain by light, moisture, or heat in the non-dye-image portion, as well as fading caused by light in the dye-image portion, and this disadvantage often incurs a problem.

The couplers commonly used for forming magenta dye images are 1,2-pyrazolo-5-ones. The magenta dyes formed from the 1,2-pyrazolo-5-one magenta couplers have disadvantages in having secondary spectral absorption in the vicinity of 430 nm, in addition to the primary spectral absorption in the vicinity of 550 nm which leads to poor color reproduction. Therefore, various studies have been conducted to solve this problem.

The magenta coupler having an anilino group on the 3 position of 1,2-pyrazolo-5-one, which exhibits less significant secondary absorption, and known to be useful in obtaining color images for print. The related techniques are disclosed, for example, in U.S. Pat. No. 2,343,703, and British Patent No. 1,059,994.

These magenta couplers are disadvantageous as they are significantly inferior in the image preservability, especially, in the stability of dye images to light, as well as in larger magnitude of Y-stains in the non-dye image portion.

Other means proposed for limiting the above-mentioned secondary absorption of magenta couplers in the vicinity of 430 nm are magenta couplers such as pyrazolobenzimidazole couplers in British Patent No. 1,047,612; indazolone couplers in U.S. Pat. No. 3,770,447; and pyrazolotriazole couplers in U.S. Pat. No. 3,725,067, British Patent Nos. 1,252,418, and 1,334,515. The dyes formed from these couplers are advantageous in terms of color reproduction, as compared with the previously mentioned dyes formed from 1,2-pyrazolo-5-ones having an anilino group on the 3 position, in having the secondary absorption in the vicinity of 430 nm, and in posing relatively small Y-stain due to light, heat, or moisture, in the non-dye image portion.

However, these couplers are found to have a serious drawback, that is, the gradation of resultant images significantly fluctuate depending on the exposure illumination intensity. It is well known fact that even with a constant exposure amount, the sensitivity of the light-sensitive material greatly varies depending on change in illumination intensity. Correspondingly, various countermeasures have been taken, for example, by changing an exposure amount in compliance with expected sensitivity change, and this drawback does not pose a problem that inhibits common use of the light-sensitive material.

If a light-sensitive material poses significantly great gradation fluctuation depending on exposure illumination intensity (hereinafter referred to as illumination dependency of gradation), this drawback poses a fatal defect to the light-sensitive material. The light-sensitive materials have different gradation designed to comply with the nature of their applications. When such materials are exposed in a practical operation, the suitable exposure illumination intensity naturally varies depending on the exposure conditions; more specifically, the brightness on a subject, in the case of the materials for picture-taking; and in the case of print material, the difference in image density resultant from overexposure or underexposure of the film bearing original image. With the light-sensitive material whose gradation having greater illumination dependency, the resultant gradation will deviate from the allowable range of designed gradation.

As a result, some scenes may have excessively hard gradation, thereby details especially in low density and high density areas can be missing, or some scenes may have excessively soft gradation and may be dull. In both cases, the quality of the light-sensitive material is significantly jeopardized.

In the case of print light-sensitive material, various print sizes are available. Commonly used sizes range from the smallest format known as "E size" to the whole sheet size. Usually, a user prints several scenes onto a small-sized photographic paper, and then the user selects preferable scenes and enlarges them to larger size prints. In this course, the film bearing the original image is the same regardless of the size of a print paper, larger or smaller. Additionally, the intensity of the light source cannot be readily intensified. Therefore, it is unavoidable that when an original image is enlarged onto a large-sized print, the exposure illumination intensity relative to the print light-sensitive material is inappropriately low. As a result, with a light-sensitive material whose gradation being significantly dependent on exposure illumination intensity, the larger print will have poor image quality and fail to satisfy the user, even this type of material may provide good image quality with a smaller print.

As described earlier, an improved exposure apparatus can cope with sensitivity change corresponding to exposure illumination intensity, to an extent not adversely affecting practical exposure operations. However, measures including improved apparatuses such as exposure apparatuses have difficulties in coping with gradation change. Therefore, it is necessary to improve illumination dependency of gradation, by means of improved light-sensitive materials.

One method to improve illumination dependency of gradation, the use of iridium compounds, is disclosed in Japanese Patent Publication Open to Public Inspection (hreinafter referred to as Japanese Patent O.P.I. Publication) Nos. 97648/1986, and 954/1987.

However, once such a compound is added in an amount enough to ensure its effect, adverse effects often occur as evidenced by desensitization, and deteriorated pressure-resistance of the light-sensitive material. Therefore, the use of such compounds has limitation.

Additionally, if the previously mentioned pyrazolotriazoles are used in conjunction, fogging readily occurs. And this disadvantage poses problems that hinder practical use of this method.

SUMMARY OF THE INVENTION

The object of the invention is to provide a color photographic light-sensitive material free from yellow stains, and devoid of gradation illumination dependency.

The above-mentioned object of the invention is achieved by a light-sensitive silver halide photographic material comprising a support and provided thereon photographic layers including at least one silver halide emulsion layer containing a magenta dye-forming coupler represented by general formula M-I;

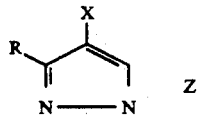

(Wherein Z represents a group of non-metal atoms necessary to complete a nitrogen-containing heterocyclic ring which may have a substituent; X represents a hydrogen atom or a substituent capable of being split off upon reaction with an oxidation product of a color developing agent; and R represents a hydrogen atom or a substituent), wherein an elementary sulfur has been added to said photographic layer at an arbitrary timing before the formation thereof on said support.

DETAILED DESCRIPTION OF THE INVENTION

The term "elementary sulfur" means the sulfur which is not in the form of a compound with other elements. Accordingly, sulfur compounds known as photographic additives in the art such as sulfide, sulfuric acid (or salt thereof), sulfurous acid (or salt thereof), thiosulfuric acid (or salt thereof), sulfuric acid (or salt thereof), thioether compound, thiourea compound, mercapto compound, and heterocyclic compounds, are not elementary sulfurs according to the invention.

The elementary sulfur according to the invention is known to take several allotropic forms, and any of which may be used in the invention. Among these allotropic forms, a form stable at a room temperature is $\alpha$-sulfur which belongs to the rhombic system. According to the present invention, the use of the $\alpha$-sulfur is advantageous.

When incorporating the "elementary sulfur" according to the invention into the silver halide emulsion layer, it is preferable to use it in the form of a solution, though the incorporation of the elementary sulfur in the solid form is also possible. Though not soluble in water, an inorganic sulfur is known to be soluble in carbon disulfide, sulfur chloride, benzene, diethyl ether, ethanol or the like, and it is favorable that the elementary sulfur be used as dissolved in any of these solvents. Among them ethanol is particularly preferred in view of its handling and photographic performance.

An appropriate amount of inorganic sulfur added varies depending on various factors such as the type of silver halide emulsion being used, or the magnitude of effect being intended. The amount of the elementary sulfur to be added is usually $1\times10^{-5}$ mg to 10 mg per 1 mol of silver halide. Addition of the elementary sulfur may be made once or may be divided into several steps.

The photographic layer where the elementary sulfur of the invention is added is either light-sensitive silver halide emulsion layer or non-light-sensitive hydrophilic colloidal layer (in the latter case, the sulfur will diffuse into the silver halide emulsion layers in the course of coating operation). However, the preferred layer where the sulfur is added is a light-sensitive silver halide emulsion layers.

Timing of adding the elementary sulfur is at a process arbitrarily selected from among those preceding the formation of silver halide emulsion layers. In other words, the timing may be either before the formation of silver halide grains; during the formation of silver halide grains; a period after the formation of silver halide grains and before the initiation of chemical sensitization; at the initiation of chemical sensitization; during chemical sensitization; at the termination of chemical sensitization; a period after the termination of chemical sensitization and before the coating operation. The preferred timings of addition are at the initiation of chemical sensitization; during chemical sensitization; before the termination of chemical sensitization.

The chemical sensitization initiation process is a process during which a chemical sensitizer is added. The start of this process is marked by the addition of a chemical sensitizer.

The chemical sensitization can be terminated by a method known in the photographic art. The known methods for terminating the chemical sensitization include a method that decreases the temperature of the emulsion; a method that decreases the pH level; and a method that uses a chemical sensitization-stopping agent. However, from the viewpoint of stability or the like of the silver halide emulsion, the particularly preferred method is a method using a chemical sensitization-stopping agent. The known useful chemical sensitization-stopping agents include halides (such as potassium bromide, and sodium chloride); organic compounds known as an anti-fogging agent or stabilizer (such as 7-hydroxy-5-methyl-1,3,4,7a-tetraazaindene). These agents can be used singly or in combination.

The inorganic sulfur of the invention can be added at the chemical sensitization stop process. The "chemical sensitization stop process" means a process where the above-mentioned chemical sensitization-stopping agent is added. In this case, the inorganic sulfur is added during the real-term chemical sensitization stop process, more specifically, at the time where a chemical sensitization-stopping agent is added or within 10 minutes before or after the addition, or, more preferably, at the timing of addition or within 5 minutes before or after the addition.

In the structure of the magenta coupler represented by the previously mentioned General Formula [M-I], below;

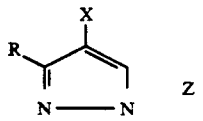

General Formula [M-I]

Z represents an atomic group necessary for forming a nitrogen-containing heterocycle, where the so-formed heterocycle may have a substituent.

X represents a hydrogen atom; or a group that is capable of being split off by reaction with an oxidation product of a color developing agent.

R represents a hydrogen atom, or a substituent group.

The substituent group represented by R is not particularly limited but is typically any of the following groups, namely, alkyl, aryl, anilino, acylamino, sulfonamide, alkylthio, arylthio, alkenyl, and cycloalkyl groups. Other examples include a halogen atom; cycloalkenyl, alkynyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imide, ureide, sulfamoylamino, alkoxycarbonylamino, aryloxy carbonylamino, alkoxycarbonyl, aryloxy carbonyl, and heterocyclic thio groups; and spiro residue and bridged hydrocarbon residue.

The alkyl group represented by R is preferably any of those having 1 to 32 carbon atoms, and may be straight-chained or branched.

The aryl group represented by R is preferably a phenyl group.

The examples of the acylamino group represented by R include alkylcarbonylamino and arylcarbonylamino groups.

The examples of the sulfonamide group represented by R include alkylsulfonylamino and arylsulfonylamino groups.

The examples of the alkyl and aryl components in the alkylthio and arylthio groups represented by R are alkyl and aryl groups each represented by R.

The alkenyl group represented by R is preferably one having 2 to 32 carbon atoms; and cycloalkyl group represented by R is favorably one having 3 to 12, more favorably 5 to 7 carbon atoms; the alkenyl group may be straight-chained or branched.

The cycloalkenyl group represented by R is favorably one having 3 to 12 carbon atoms, more favorably 5 to 7 carbon atoms.

The examples of the sulfonyl group represented by R include alkylsulfonyl and arylsulfonyl groups.

The examples of the so-represented sulfinyl group include alkylsulfinyl and arylsulfinyl groups.

The examples of the so-represented phosphonyl group include alkylphosphonyl, alkoxyphosphonyl, aryloxyphosphonyl, and arylphosphonyl groups.

The examples of the so-represented acyl group include alkylcarbonyl and arylcarbonyl groups.

The examples of the so-represented carbamoyl group include alkylcarbamoyl and arylcarbamoyl groups.

The examples of the so-represented sulfamoyl group include alkylsulfamoyl and arylsulfamoyl groups.

The examples of the so-represented acyloxy group include alkylcarbonyloxy and arylcarbonyloxy groups.

The examples of the so-represented carbamoyloxy group include alkylcarbamoyloxy and arylcarbamoyloxy groups.

The examples of the so-represented ureide group include alkylureide and arylureide groups.

The examples of the so-represented sulfamoylamino group include alkylsulfamoyl amino and arylsulfamoyl amino groups.

The so-represented heterocyclic group is preferably five- to seven-membered one, and the examples of the five-to seven membered one include 2-furil, 2-thienyl, 2-pyrimidinyl, or 2-benzothiazolyl group.

The so-represented heterocyclic oxy group is preferably one having a five- to seven-membered heterocyclic ring, and typically, 3,4,5,6-tetrahydropyranyl-2-oxy group or 1-phenyl-tetrazole-5-oxy group.

The so-represented heterocyclic thio group is preferably a five- to seven-membered heterocyclic thio group, for example, 2-pyridylthio, 2-benzothiazolylthio, or 2,4,-di-phenoxy-1,3,5-triazole-6-thio group.

The examples of the so-represented siloxy group include trimethylsiloxy, triethylsiloxy, and dimethylbutylsiloxy groups.

The examples of the so-represented imide group include succinimide, 3-heptadecyl succinimide, phthalimide, and glutarimide groups.

The examples of the so-represented spiro residue include spiro [3,3]heptane-1-yl.

The examples of the so-represented bridged hydrocarbon residue include bicyclo[2,2,1]heptane-1-yl, tricyclo[3,3,1,1$^{3,7}$]decane-1-yl, and 7,7-dimethyl-bicyclo[2,2,1]heptane-1-yl. The examples of the group that is represented by X and is capable of being split off by reaction with an oxidation product of the color developing agent include halogen atoms (e.g., chlorine, bromine, and fluorine atoms); alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclic thio, alkyloxythio carbonylthio, acylamino, sulfonamide, N-atom bonded nitrogen-containing heterocycle, alkyloxycarbonylamino, aryloxycarbonylamino, carboxyl, and

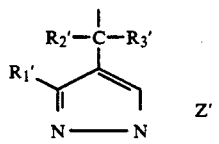

(wherein $R_1'$ is synonymous with the previously defined R; Z', synonymous with the previously defined Z; and $R_2'$ and $R_3'$ independently represent a hydrogen atom, or aryl, alkyl, or heterocyclic group). Among these examples, however, a particularly preferred one is a halogen atom, especially, chlorine atom.

The examples of the nitrogen-containing heterocyclic ring formed by Z or Z' include pyrazole, imidazole, triazole, and tetrazole rings. For the substituent groups which any of these rings may have, those mentioned with respect to the previously defined R are available.

The couplers represented by General Formula [M-I] are more specifically represented by the following General Formulas [M-II] through [M-VII]:

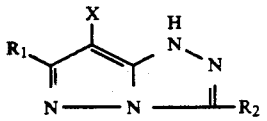
General Formula [M-II]

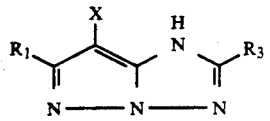
General Formula [M-III]

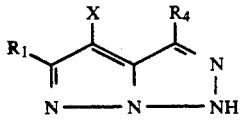
General Formula [M-IV]

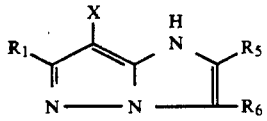
General Formula [M-V]

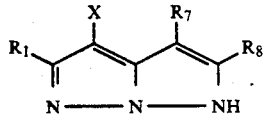
General Formula [M-VI]

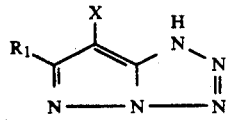
General Formula [M-VII]

In Formulas [M-II] through [M-VII] above, $R_1$ through $R_8$ and X are synonymous with the previously mentioned R and X.

Among the couplers expressed by General Formula [M-I], the particularly preferred are those expressed by the following General Formula [M-VIII].

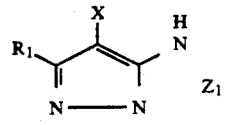
General Formula [M-VIII]

In this formula, $R_1$, X, and $Z_1$ are synonymous with R, X, and Z in General Formula [M-I].

Of the magenta couplers previously expressed by General Formulas [M-II] to [M-VII], the most advantageous are those expressed by General Formula [M-II].

As the substituent which a ring formed by Z in General Formula [M-I], or a ring formed by $Z_1$ in General Formula [M-VIII], may have, or as any of $R_1$ through $R_8$ in General Formulas [M-II] through [M-VI], those expressed by the following General Formula [M-IX] are particularly preferred.

$$-R^1-SO_2-R^2$$ General Formula [M-IX]

In the formula, $R^1$ represents an alkylene group, and $R^2$ represents an alkyl group, a cycloalkyl group, or an aryl group.

The alkylene group represented by $R^1$ has a straight chain portion having preferably 2 or more carbon atoms, in particular, 3 to 6 carbon atoms, and may be of either straight chained or branched configuration.

As the cycloalkyl group represented by $R^2$, a five-or six-membered one is preferred.

If the light-sensitive material is used for positive image formation, the particularly preferable substituent groups R and $R_1$ on the previously mentioned heterocyclic ring are those represented by the following General Formula [M-X].

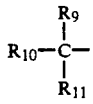
General Formula [M-X]

In the formula, R , $R_{10}$, and $R_{11}$, are synonymous with aforesaid R.

Two of above mentioned $R_9$, $R_{10}$, and $R_{11}$, for example, $R_9$ and $R_{10}$, may be interlinked together to form a saturated or unsaturated ring (e.g., cycloalkane, cycloalkene, or heterocycle), and further, $R_{11}$ may be combined with the ring to form a bridged hydrocarbon residue group.

With General Formula [M-X], it is preferable that (i) at least two of $R_9$ through $R_{11}$ are alkyl groups, or that (ii) one of $R_9$ through $R_{11}$, for example, $R_{11}$ is a hydrogen atom, wherein the other two i.e. $R_9$ and $R_{10}$ are interlinked together to form cycloalkyl in conjunction with a bridgehead atom.

Further, in the above case (i), it is preferable that two of $R_9$ through $R_{11}$ are alkyl groups, while the other one is a hydrogen atom or an alkyl group.

If the light-sensitive material of the invention is used for negative image formation, the particularly preferable substituent groups R and $R_1$ on the above mentioned heterocycle are those represented by the following General Formula [M-XI].

$$-R_{12}-CH_2-$$ General Formula [M-XI]

$R_{12}$ in this formula is synonymous with aforesaid R.

$R_{12}$ is preferably a hydrogen atom, or an alkyl group.

The typical examples of the compounds according to the invention are as follows.

1
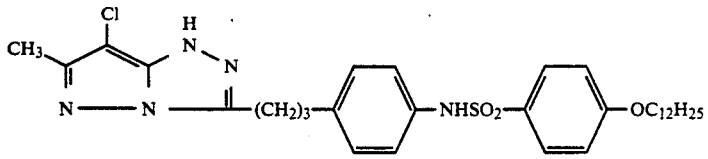
2
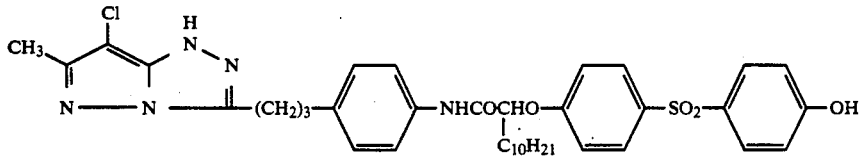
3
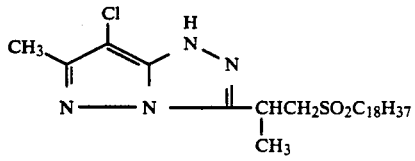
4
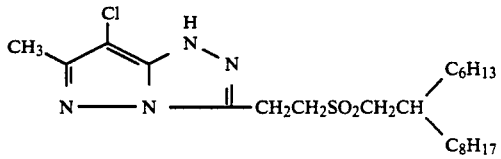
5
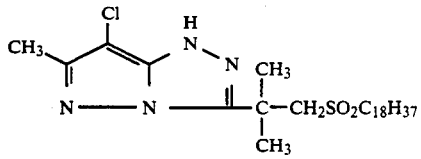
6
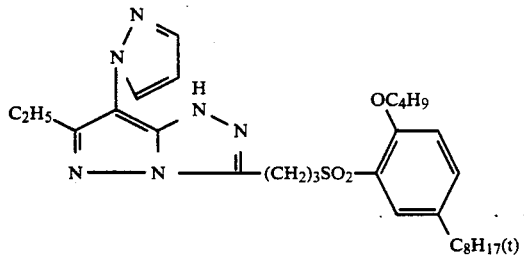
7
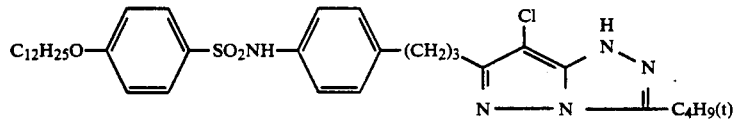
8
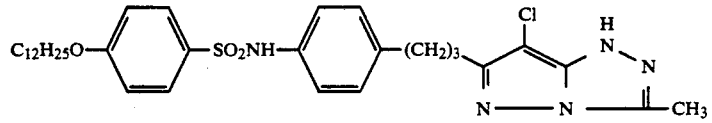
9
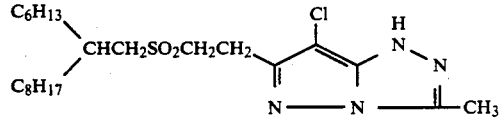

-continued
10
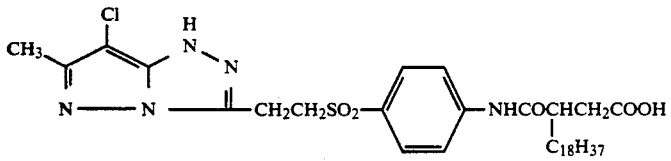
11
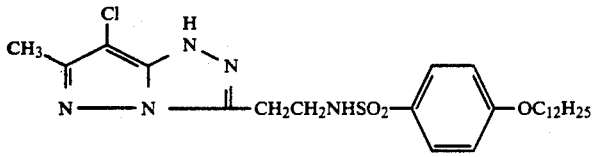
12
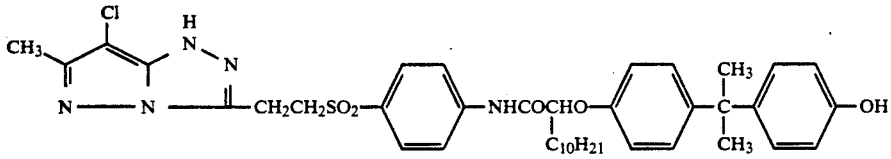
13
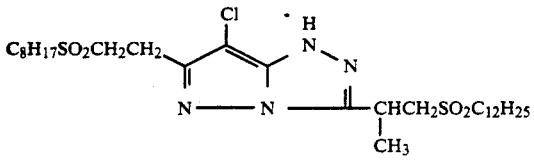
14
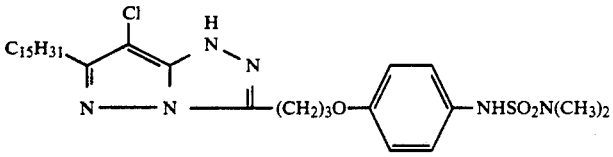
15
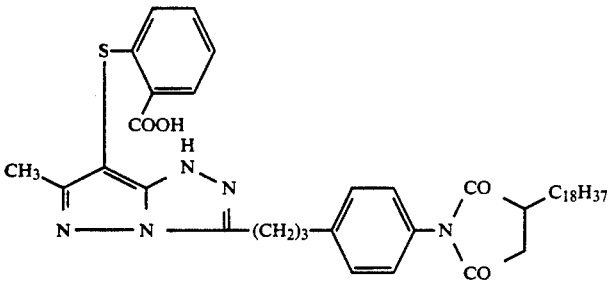
16
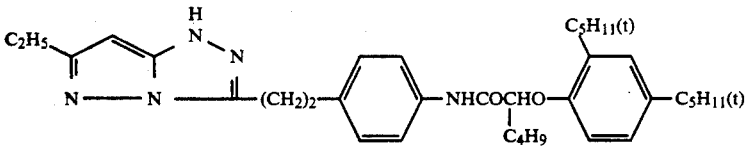
17
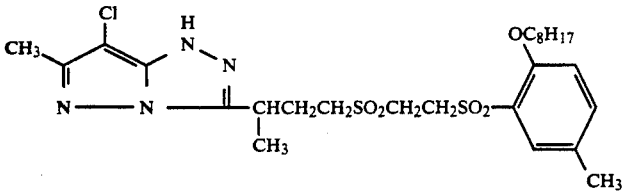
18
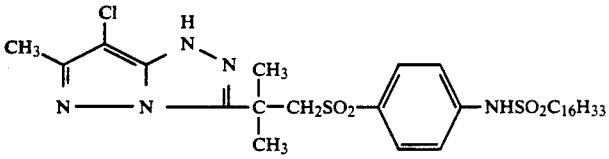

-continued
19
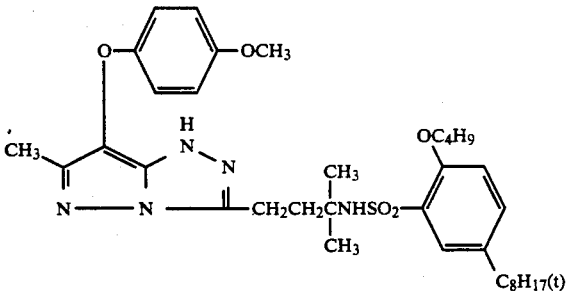
20
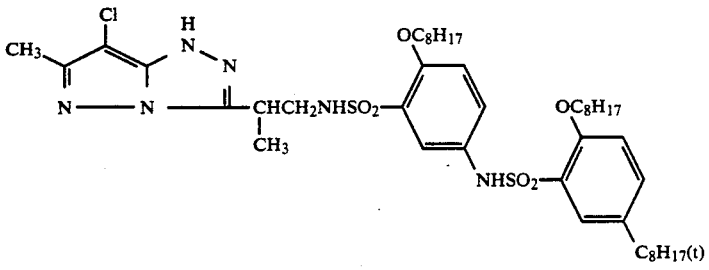
21
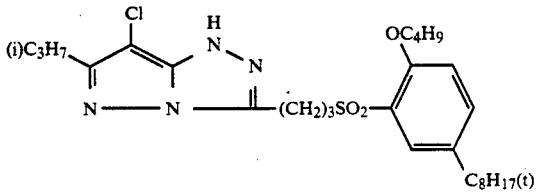
22
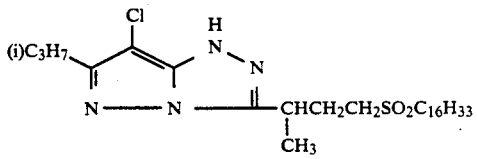
23
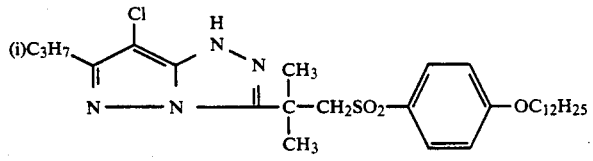
24
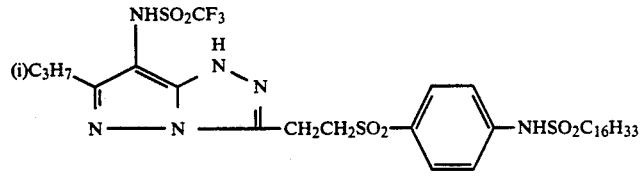
25
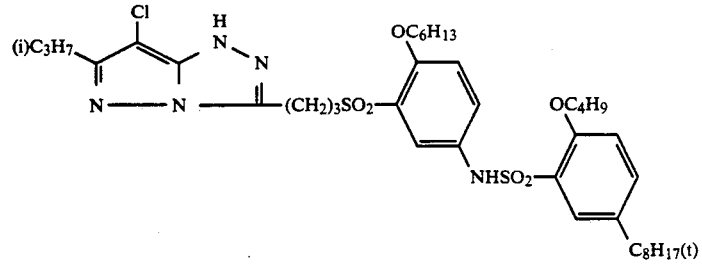

-continued
26
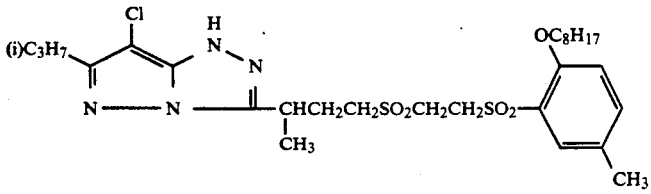
27
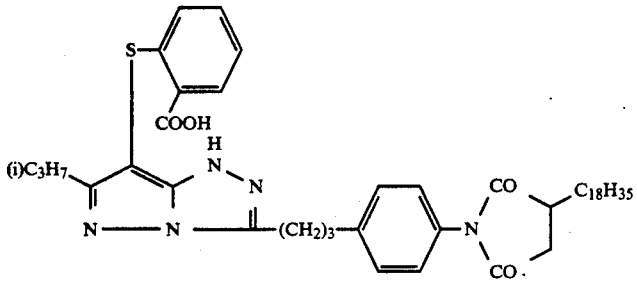
28
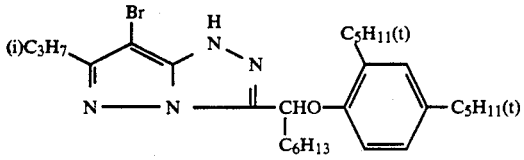
29
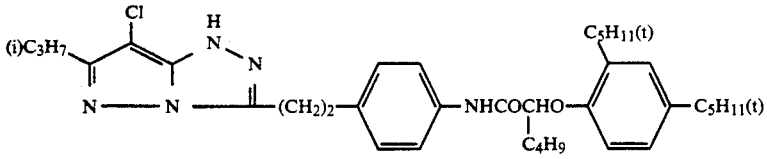
30
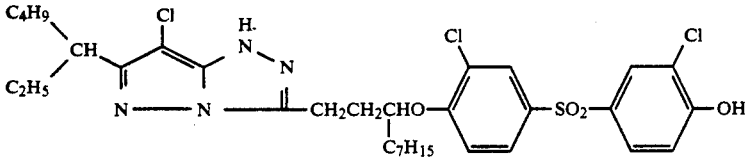
31
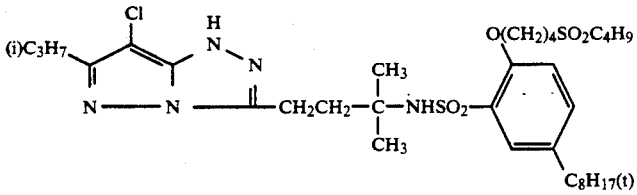
32
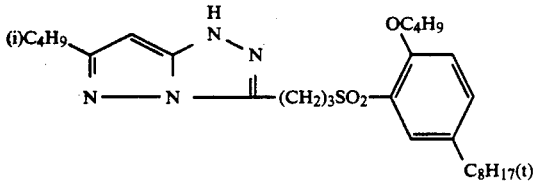
33
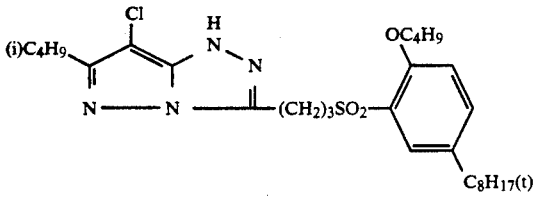

-continued
34
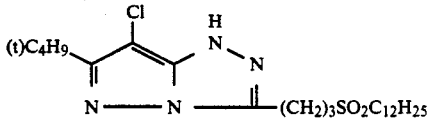
35
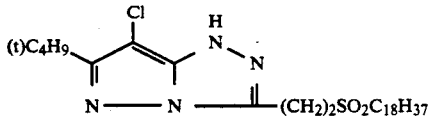
36
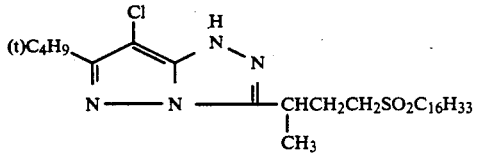
37
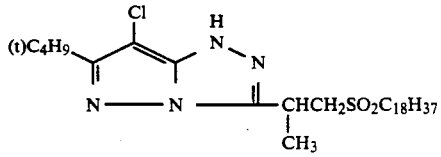
38
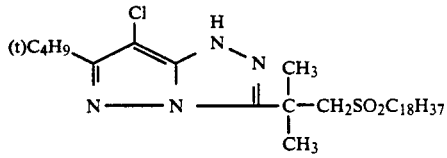
39
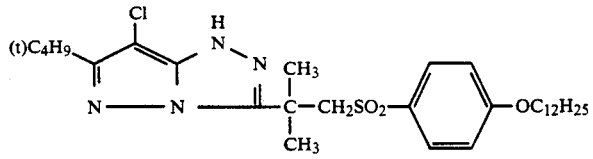
40
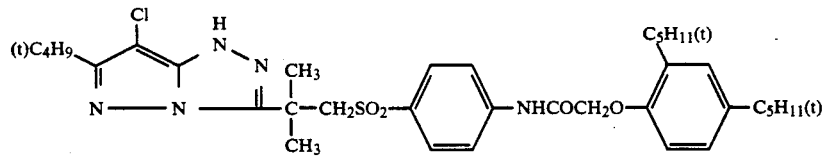
41
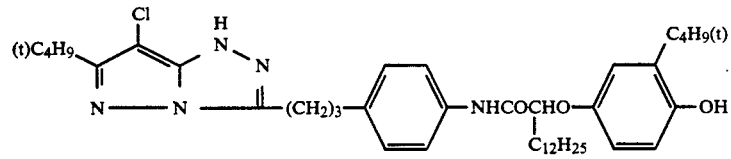
42
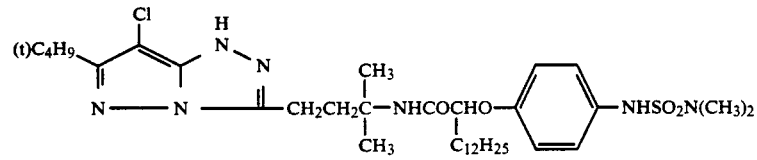

-continued
43
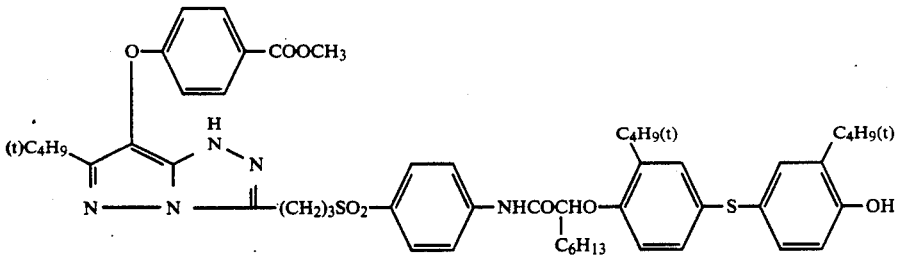
44
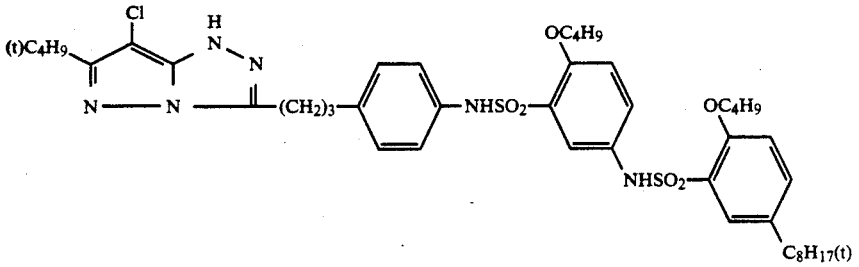
45
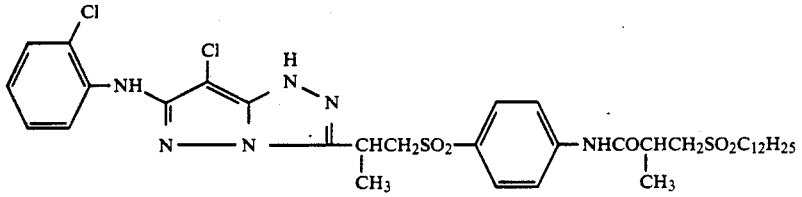
46
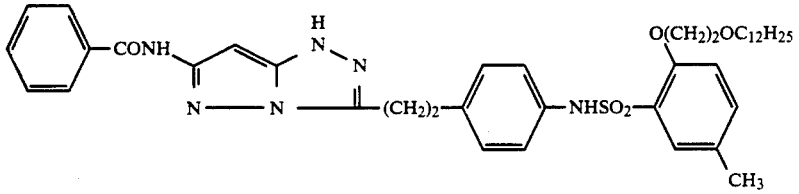
47
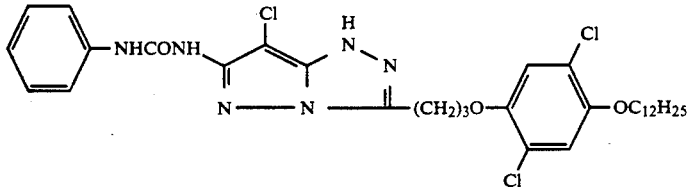
48
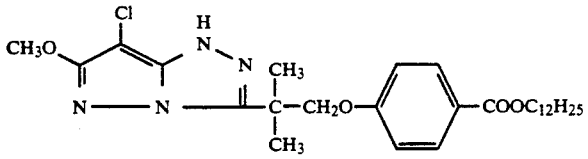
49
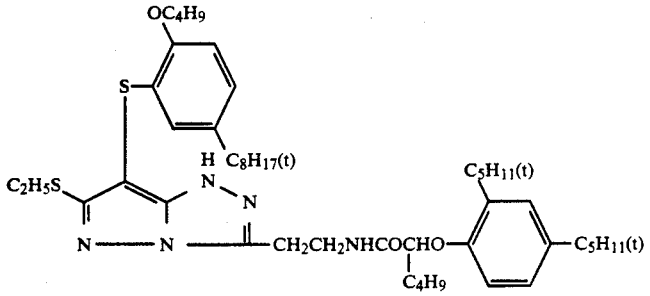

-continued
50
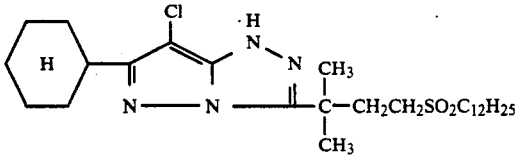
51
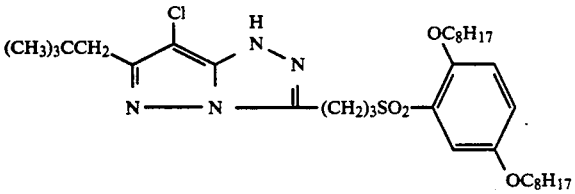
52
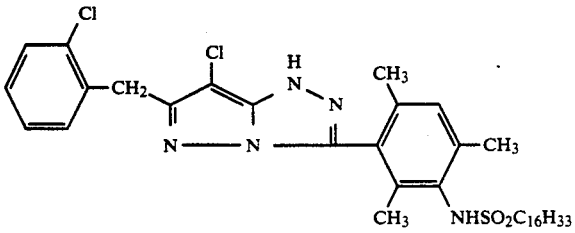
53
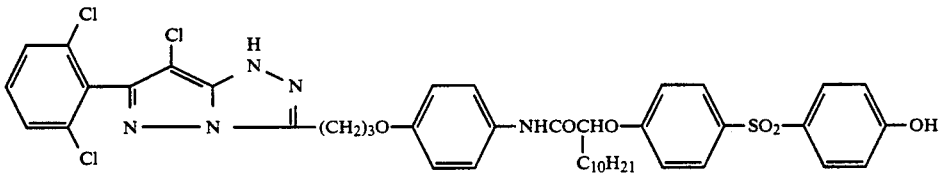
54
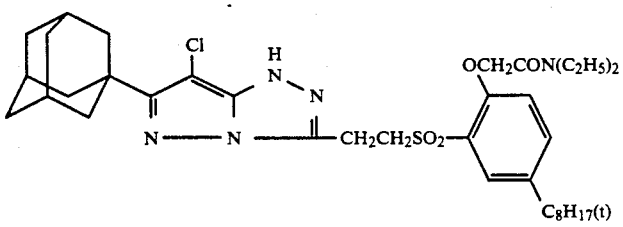
55
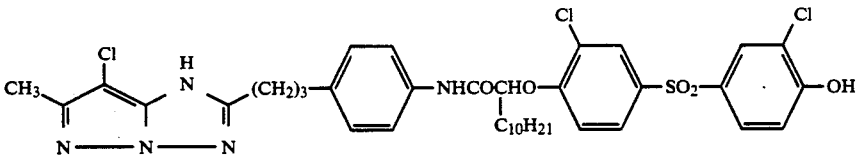
56
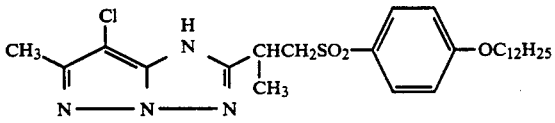
57
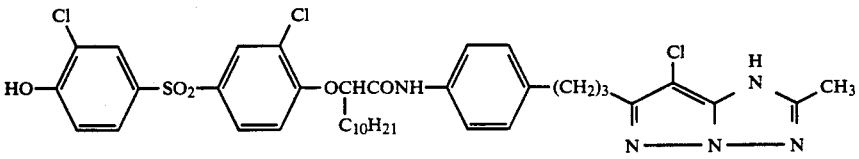

-continued
58
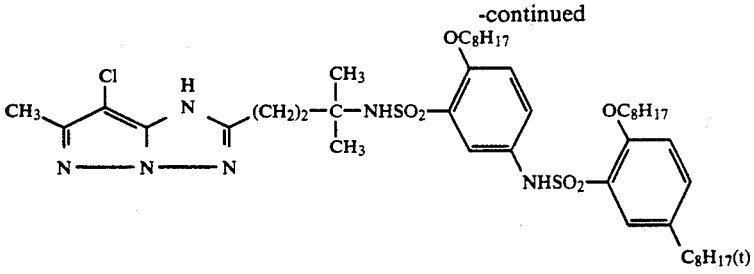
59
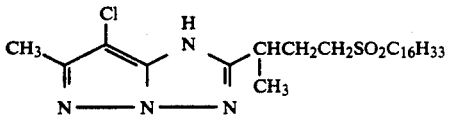
60
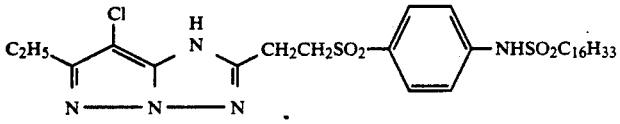
61
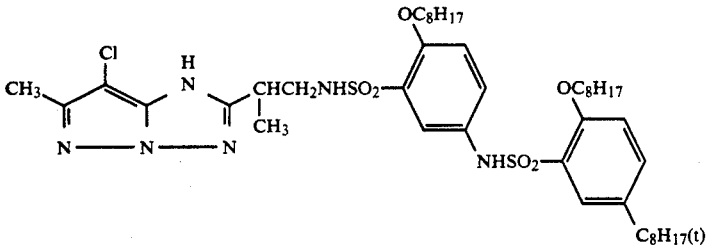
62
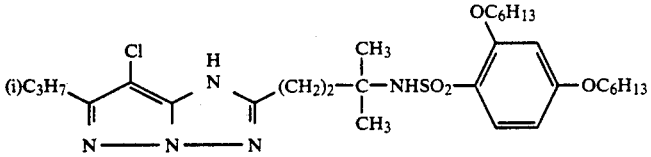
63
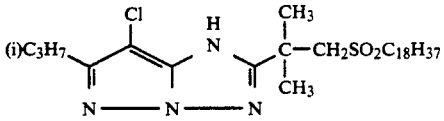
64
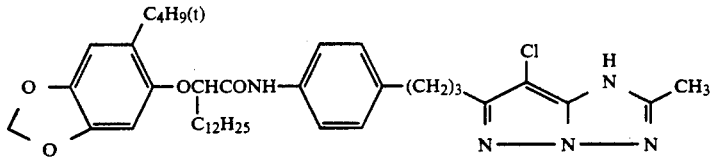
65
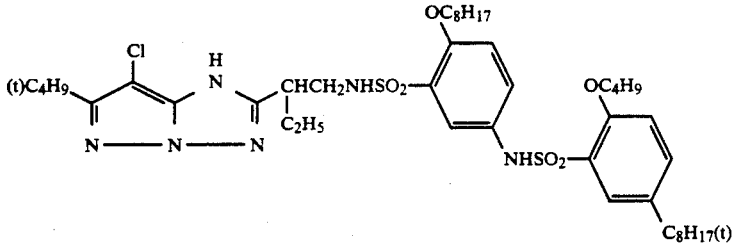
66
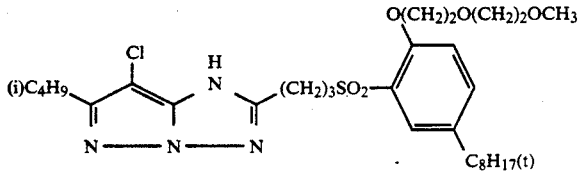

-continued
67
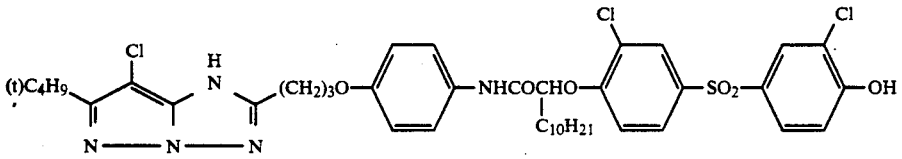
68
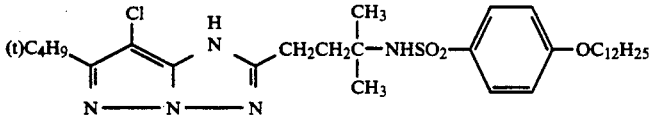
69
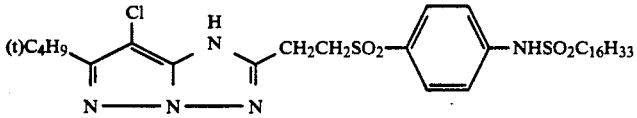
70
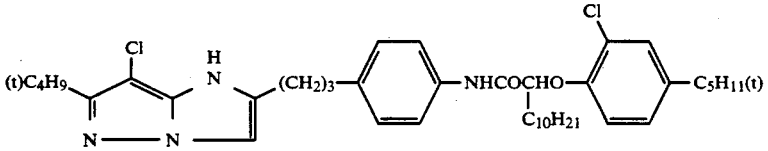
71
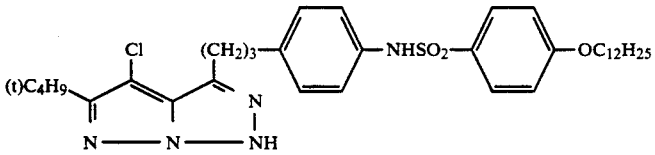
72
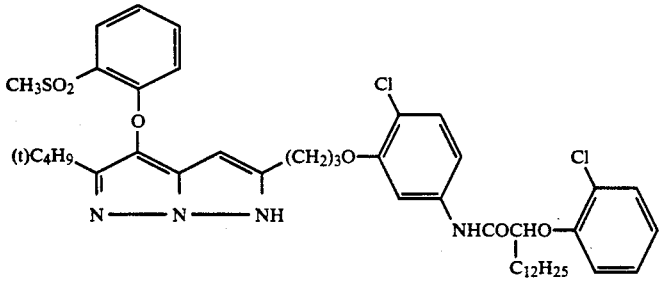
73
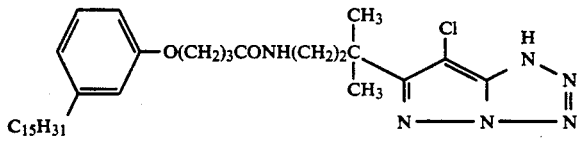
74
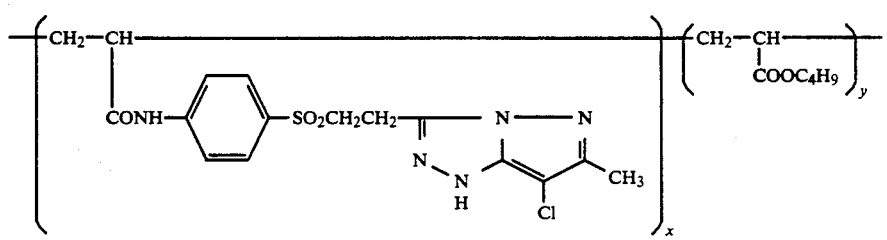
x:y = 50:50

-continued

75

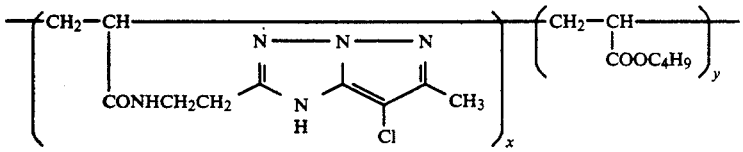

x:y = 50:50

76

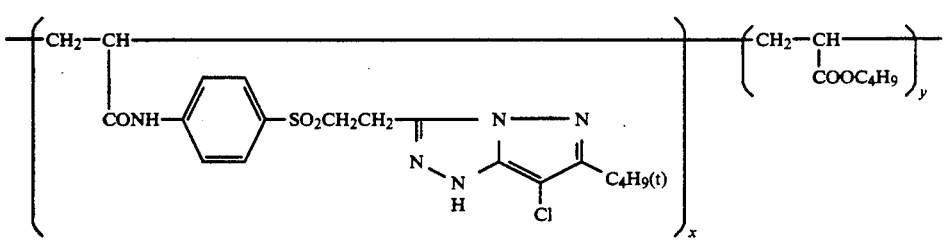

x:y = 50:50

77

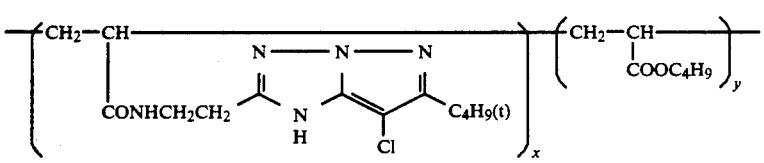

x:y = 50:50

In addition to the typical examples given above, other examples of the compounds of the invention are those shown by Nos. 1 through 4, 6, 8 through 17, 19 through 24, 26 through 43, 45 through 59, 61 through 104, 106 through 121, 123 through 162, and 164 through 223, of those described in pp. 66–122 of the specification of Japanese Patent O.P.I. Publication No. 166339/1987.

These couplers can be synthesized by referring to Journal of the Chemical Society, Perkin I (1977), pp. 2047–2052; U.S. Patent No. 3,725,067, and Japanese Patent O.P.I. Publication Nos. 99437/1984, 42045/1983, 162548/1984, 171956/1984, 33552/1985, 43659/1985, 172982/1985, and 190779/1985.

The couplers of the invention are usually used in an amount of $1\times10^{-3}$ mols to 1 mol, or, preferably, $1\times10^{-2}$ mol to $8\times10^{-1}$ mols, per mol silver halide.

The couplers of the invention can be used in conjunction with other types of magenta couplers.

The silver halide grains in the silver halide emulsion of the invention can be any of silver chloride, silver chloro-bromide, silver bromide, silver iodo-bromide, and silver chloro-iodo-bromide, and, can be mixture of these types of grains.

However, the particularly advantageous emulsion is a silver chloride-containing emulsion. More specifically, the high-silver chloride emulsion is advantageous in having significantly good rapid-processability.

Because the effect of combinedly using the inorganic sulfur of the invention and a magenta coupler represented by General Formula [M-I] is more significant, the high chloride silver halide grains comprise not less than 80 mol %, or, preferably, not less than 90 mol % of silver chloride; not more than 20 mol %, or, preferably, not more than 10 mol % of silver bromide; and not more than 0.5 mol % of silver iodide. More specifically, the preferred silver bromide content is 0 to 5 mol %.

The weight ratio of silver halide grains whose silver chloride content being not less than 90 mol % among the whole silver halide grains in the silver halide emulsion layer is not less than 60 wt %, or, preferably, not less than 80 wt %. The composition of silver halide grains, where the grains are high chloride silver halide grains used in conjunction with the inorganic sulfur, can be uniform the core to exterior of each grain, or the composition of the grain interior can be different from that of the exterior. If the composition of the grain interior is different from that of the exterior, the composition can vary either continuously or discontinuously.

The size of the silver halide grains used in the invention is not specifically limited. However, from the viewpoints of rapid-processability, sensitivity and other photographic performance criteria, the preferred size is within a range of 0.2 to 1.6 μm, or, more specifically, 0.25 to 1.2 μm.

The grain size can be measured by a variety of methods commonly used in the photographic art. The typical methods are described in "Analysis Method of Grain Size" (by Labrand), A.S.T.M. Symposium on Light Microscopy (1955), pp. 94–122; "The Theory of the Photographic Process" by Mees and James, 3rd edition, Chapter 2, published from Macmillan Company (1966).

The grain sizes can be measured based on projected areas or can be determined by directly using approximate diameter values of grains.

When silver halide grains have virtually identical configurations, the grain size distribution can be expressed with considerable precision by diameter or projected area.

The grain size distribution of the silver halide grains may be either multidispersed or monodispersed type. However, the monodispersed silver halide grains of variation coefficient of not more than 0.22, or, preferably, not more than 0.15, in terms of the size distribution of the silver halide grains contained in an emulsion. The variation coefficient is a coefficient indicating the range of the grain size distribution and is defined by the following expressions.

Variation coefficient $(S/r)$ =

$$\frac{\text{Standard deviation of size distribution}}{\text{Average grain size}}$$

Standard deviation of grain size distribution $(S)$ =

$$\sqrt{\frac{\Sigma (r - ri)^2 ni}{\Sigma ni}}$$

$$\text{Average grain size } (r) = (r) = \frac{\Sigma niri}{\Sigma ni}$$

In the above expressions, ri represents sizes of independent grains; ni, a number of independent grains counted. The term "grain" size here means a diameter of independent spherical silver halide grain; a diameter, when the grain is cubic or has any shape other than spherical shape, of a projected image converted into a disc image.

The silver halide grains according to the invention can be prepared by any of the acid process, neutral process, and ammonium process. The grains may be grown at once, or may be grown after seed grains are formed.

A method for forming seed grains may be identical with or different from a method for growing the grains.

As a method for reacting soluble silver salt with soluble halide salt, the normal precipitation method, reverse precipitation method or double-jet precipitation method, or the combination of these methods is arbitrarily used. The preferred grains are those prepared by the double-jet precipitation method. Furthermore, pAg-controlled double-jet method disclosed, for example, in Japanese Patent O.P.I. Publication No. 48521/1979, that is, one modification of the double-jet precipitation method, may be used.

If necessary, a solvent for silver halide such as thioether may be used.

Additionally, a compound such as a mercapto-group containing compound, nitrogen-containing compound and sensitizing dye can be added during or after the formation of silver halide grains.

The configurations of silver halide grains according to the invention are arbitrarily selected.

The preferred one example is a cubic grain having {100} face as a crystal face. Additionally, octahedral, tetradecahedral or dodecahedral grains may be prepared using the methods described in U.S. Pat. Nos. 4,183,756, and 4,225,666, Japanese Patent O.P.I. Publication No. 26589/1980, Japanese Patent Examined Publication No. 42737/1980, and in the Journal of Photographic Science 21, 39 (1973), and the like, thereby the resultant silver halide grains may be used in embodying the invention.

Also, grains having twin plane can be used.

The silver halide grains may comprise grains of a common configuration, or may be a mixture of various configurations.

With the silver halide grains used in the silver halide emulsion of the invention, metal atoms in the form of metallic ions may be integrated into the interior and/or onto the surface of each grain by using cadmium salt, zinc salt, lead salt, thallium salt, iridium salt or complex salt thereof, rhodium salt or complex salt thereof, or iron salt or complex salt thereof, in the course of forming and/or growing the grains. Additionally, by subjecting the grains to an adequate reducing atmosphere, the reduction-sensitization nucleus is incorporated into the interior and/or onto the surface of every grain.

Once the silver halide grains have satisfactorily grown, excess soluble salts may be either removed or left unremoved from the halide emulsion of the invention.

Such salts can be removed in compliance with the methods described in Research Disclosure No. 17643.

The silver halide grains of the invention may be those where latent images are primarily formed either on the surface thereof or in the interior thereof. The preferred grains are those where latent images are primarily formed on the surface thereof.

According to the invention, chemical sensitizers such as a chalcogen sensitizer can be used. The chalcogen sensitizer is a general term covering sulfur sensitizer, selenium sensitizer, and tellurium sensitizer. Sulfur or selenium sensitizer is advantageous for photographic application. Sulfur sensitizers useful can be conventionally known sensitizers including thiosulfate, allylthiocarbazide, thiourea, allylisothiocyanate, cystine, p-toluene thiosulfonate, and rhodanine. Other useful sulfur sensitizers are described, for example, in U.S. Pat. Nos. 1,574,944, 2,410,689, 2,278,947, 2,728,668, 3,501,313, 3,656,955, West German OLS 1,422,869, and Japanese Patent O.P.I. Publication Nos. 24937/1971 and 45016/1980. The amount of sulfur sensitizer being added is $10^{-7}$ to $10^{-1}$ mol per mol silver halide, although the amount greatly varies depending on various conditions such as pH, temperature and silver halide grain size.

Selenium sensitizers may be used instead of sulfur sensitizers. The examples of useful selenium sensitizers include aliphatic isoselenocyanates such as allylisocyanate; selenoureas; selenoketones; selenoamides; selenocarboxylic salts and esters; selenophosphates; and selenides such as diethyl selenide and diethyl diselenide. The typical examples of these selenium sensitizers are described in U.S. Pat. Nos. 1,574,944, 1,602,592, and 1,623,499. Further, sensitization may also be used. Useful reducing agents include known stannous chloride, thiourea dioxide, hydrazine, and polyamine. Other examples of useful reducing agents include noble metal compounds such as gold compound, platinum compound, and palladium compound.

The oxidation number of gold in the gold sensitizers can be +1 or +3. And other types of gold compounds can be used for this purpose. The typical examples of the gold sensitizers include chloroaurate, potassium chloroaurate, auric trichloride, potassium auric thiocyanate, potassium iodoaurate, tetracyanoauric azide, ammonium aurothiocyanate, pyridyl trichloro gold, gold sulfide, and gold selenide.

The amount of gold sensitizer added varies depending on various conditions. As a guideline, the amount is $10^{-8}$ to $10^{-1}$ mol, or, preferably, $10^{-7}$ to $10^{-2}$ mol per mol silver halide. The timing of adding these compounds can be arbitrarily selected from during the formation of silver halide grains, during physical ripening, during chemical ripening, and after the termination of chemical ripening. According to the invention, the use of a gold compound can provide a light-sensitivity of better reciprocity law characteristics.

The photographic emulsion according to the invention is spectrally sensitized to have sensitivity to an intended spectral range, by using a dye known in the photographic art as a sensitizing dye. The sensitizing dyes may be used either singly or in combination of more than two types.

In conjunction with a sensitizing dye, a supersensitizer, that is a compound capable of enhancing the sensitizing action of a sensitizing dye though it does not provide spectral sensitization action nor absorb visible light, may be incorporated into a photographic emulsion.

To the emulsion of the invention can be added a compound known in the art as an anti-fogging agent or a stabilizer, during and/or upon completion of the chemical ripening, and/or after the chemical ripening and before coating-application of the silver halide emulsion, in order to inhibit fogging during the manufacturing, storage and photographic process of the light-sensitive material and/or to stabilize the photographic performance.

According to the invention, a nitrogen-containing heterocyclic compound whose solubility product (Ksp) relative to silver ion is not larger than $1\times10^{-10}$, or, preferably, not larger than $1\times10^{-11}$, (hereinafter referred to as an inhibitor) is effectively used The measurement and arithmetic determination can be performed by referring to "New Experimental Chemistry Lessons Vol. 1" (published by Maruzen), pp. 233-250.

The inhibitors of the invention include the compounds described in, for example, Chemical and Pharmaceutical Bulletin (Tokyo) Vol. 26, 314 (1978); Japanese Patent O.P.I. Publication No. 79436/1980; Berichte der Deutschen Chemischen Gesellsdraft 82, 121 (1948); U.S. Pat. Nos. 2,,843,491, and 3,017,270; British Patent No. 940,169; Japanese Patent O.P.I. Publication No. 102639/1976; Journal of American Chemical Society, 44, pp. 1502-1510; Beilsteins Handbuch der Organischen Chemie 26, 41, 58. The synthesis methods can be those described in the literature above When a purine derivative compound or a mercapto-group containing compound represented by the following General Formula [II] is used as the inhibitor of the invention, use in conjunction with inorganic sulfur further enhances the effect of the invention.

$Z_0$—SM General Formula [II]

In this formula $Z_0$ represents heterocyclic residue; M, a hydrogen atom, alkali metal atom, or ammonium. Preferably the heterocyclic unit of the nitrogen-containing heterocyclic compound is an imidazole, triazole or tetrazole.

The inhibitors of the invention can be used singly or in combination of two or more, and can be used in conjunction with another stabilizer or anti-fogging agent other than the inhibitors of the invention.

The timing of adding the inhibitor to the silver halide emulsion layer is arbitrarily selected from the periods before and during the formation of the silver halide grains; after the termination of silver halide grain formation and before the initiation of chemical ripening; during the chemical ripening; after the termination of chemical ripening and before the coating operation. The preferable timing of addition is at the initiation and/or termination of the chemical ripening. The total amount of inhibitor can be added at once, on in steps.

Additionally, the inhibitor can be added to a coating solution for a non-light-sensitive hydrophilic colloid layer adjacent to the silver halide emulsion layer. In this case, the inhibitor is transferred to the emulsion layer after the coating operation, thereby the inhibitor is incorporated into the silver halide emulsion layer.

Incorporating the inhibitor of the invention into the silver halide emulsion layer or the non-light-sensitive hydrophilic colloid layer is achieved by dissolving it into an organic solvent which is miscible with water at an arbitrary proportion (such as methanol and ethanol), and by incorporating the resultant solution into such a layer.

The amount of the inhibitor added to the silver halide emulsion layer is not specifically limited. However, usually, the amount is $1\times10^{-6}$ to $1\times10^{-1}$ mol, or, preferably, $1\times10^{-5}$ to $1\times10^{-2}$ mol per mol silver halide. If the inhibitor is added to the non-light-sensitive hydrophilic colloid layer, the amount of addition is preferably 1.5 to 3 times that of the inhibitor added to the silver halide emulsion layer. The typical examples of the inhibitor of the invention are as follows.

S-1

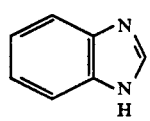

S-2

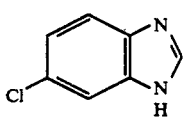

S-3

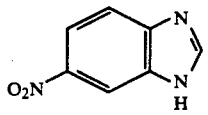

S-4

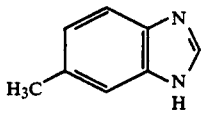

S-5

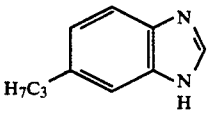

S-6

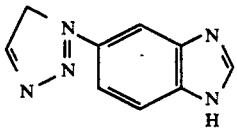

S-7

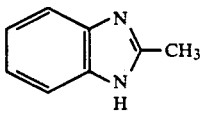

S-8

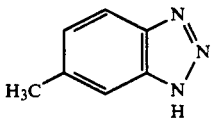

-continued
| | | | |
|---|---|---|---|
| S-9 | 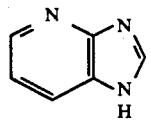 | S-10 | 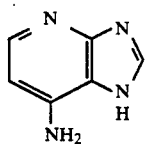 |
| S-11 | 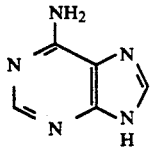 | S-12 | 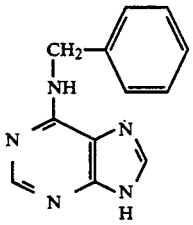 |
| S-13 | 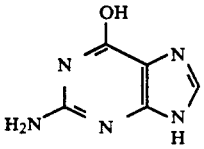 | S-14 | 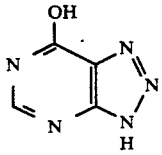 |
| S-15 | 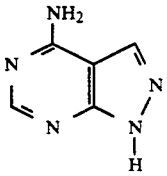 | S-16 | 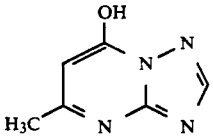 |
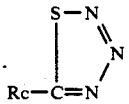
| Example Compound No. | Rc |
|---|---|
| S-17 | $-NH_2$ |
| S-18 | 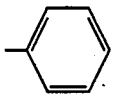 |
| S-19 | 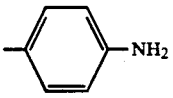 |
| S-20 | $-NO_2$ |
| S-21 | 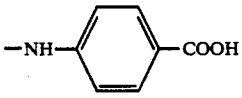 |
| S-22 | 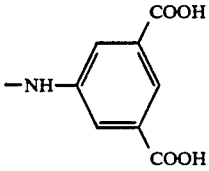 |

-continued
S-23
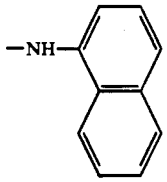
S-24
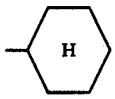
S-25
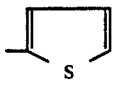
S-26
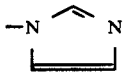
S-27
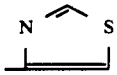
S-28
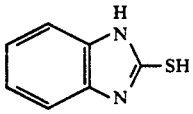
S-29
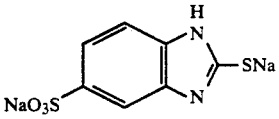
S-30
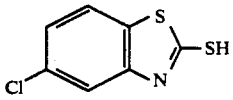
S-31
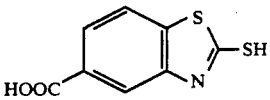
S-32
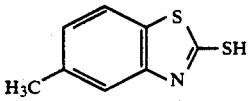
S-33
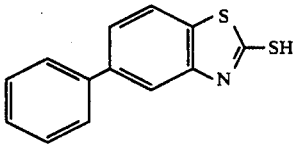
S-34
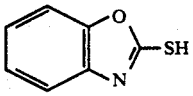
S-35
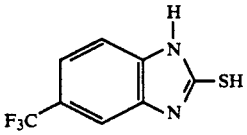
S-36
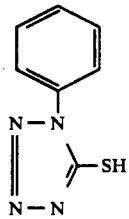
S-37
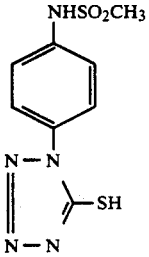

-continued
S-38
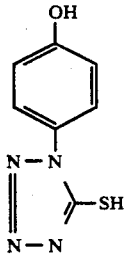
S-39
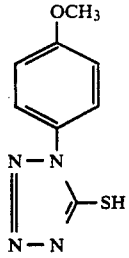
S-40
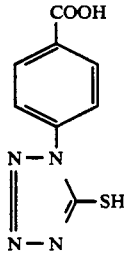
S-41
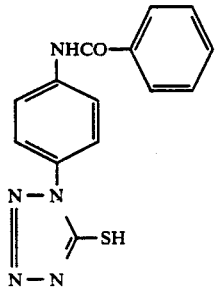
S-42
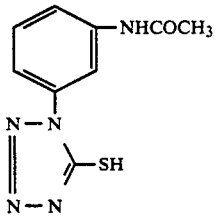
S-43
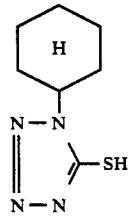
S-44
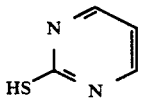
S-45
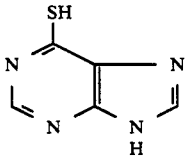
S-46
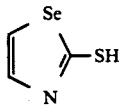
S-47
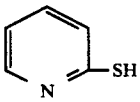
S-48
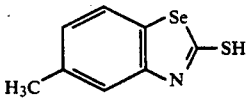
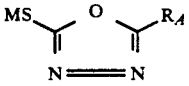
| Example compound No. | $R_A$ | M |
|---|---|---|
| S-49 | $-C_2H_5$ | —H |
| S-50 | $-CH_2-CH=CH_2$ | —H |
| S-51 | $-CH=CH-CH_2-CH_3$ | —H |
| S-52 | $-C_7H_{15}$ | —H |
| S-53 | $-C_9H_{19}$ | —Na |
| S-54 | 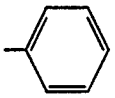 | —H |
| S-55 | $-C_4H_9(t)$ | —H |

-continued
| | | |
|---|---|---|
| S-56 | 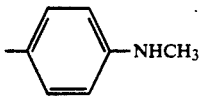 | —H |
| S-57 | 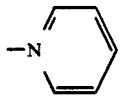 | —H |
| S-58 | 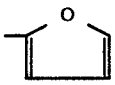 | —H |
| S-59 | 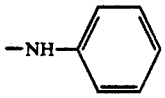 | —H |
| S-60 | 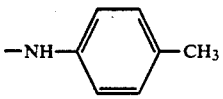 | —$NH_4$ |
| S-61 | —$NHCOCH_3$ | —H |
| S-62 | 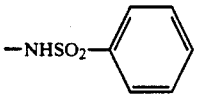 | —H |
| S-63 | —$N(CH_3)_2$ | —H |
| S-64 | 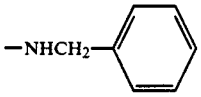 | —H |
| S-65 | 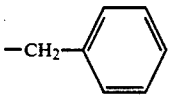 | —H |
| S-66 | —S—$CH_3$ | —H |
| S-67 | 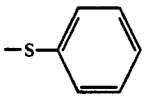 | —H |
| S-68 | —SH | —H |
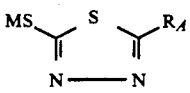
| Example compound No. | $R_A$ | M |
|---|---|---|
| S-69 | —H | —H |
| S-70 | —$C_2H_5$ | —H |
| S-71 | —$C_4H_9$(t) | —H |
| S-72 | —$C_6H_{13}$ | —H |
| S-73 | 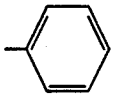 | —H |
| S-74 | | |

-continued
| | | |
|---|---|---|
| S-75 | 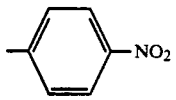 | —H |
| S-76 | 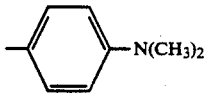 | —H |
| S-77 | 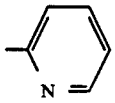 | —H |
| S-78 | 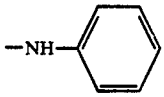 | —H |
| S-79 | $-N(CH_3)_2$ | —H |
| | $-CH_2CH{=}CH_2$ | —H |
| S-80 | —SH | —H |
| S-81 | $-NHCOC_2H_5$ | —H |
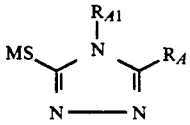
| Compound | $R_A$ | $R_{A1}$ | M |
|---|---|---|---|
| S-82 | $-C_2H_5$ | —H | H |
| S-83 | $-CH_3$ | $-CH_3$ | H |
| S-84 | $-CH_3$ | 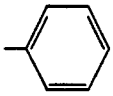 | H |
| S-85 | $-NHCOCH_3$ | $-CH_3$ | H |
| S-86 | 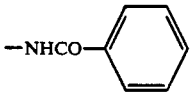 | 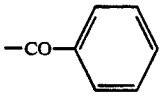 | H |
| S-87 | $-NHCOCH_3$ | $-CO-CH_3$ | H |
| S-88 | $-NHCOCH_3$ | 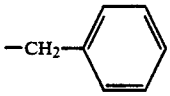 | H |
| S-89 | $-NHCOC_2H_5$ | 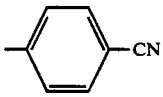 | Na |
| S-90 | 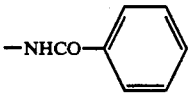 | 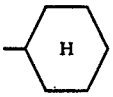 | H |
| S-91 | $-NHSO_2CH_3$ | —H | H |
| S-92 | 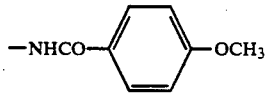 | $-CH_3$ | Na |

-continued

| | | | |
|---|---|---|---|
| S-93 | 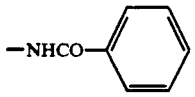 | $-CH_2CH{=}CH_2$ | H |
| S-94 | 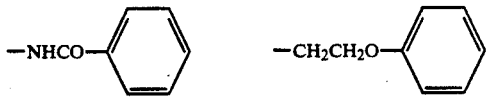 | | H |

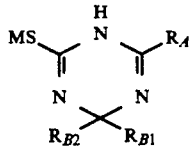

| Compound | $R_A$ | $R_{A1}$ | | M |
|---|---|---|---|---|
| S-95 | $-C_2H_5$ | $-CH_3$ | $-CH_3$ | $-H$ |
| S-96 | 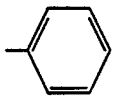 | $-CH_3$ | $-CH_3$ | $-H$ |
| S-97 | $-NH_2$ | $-H$ | 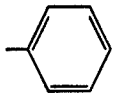 | $-H$ |
| S-98 | 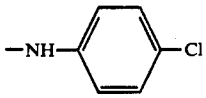 | $-H$ | $-C_4H_9$ | $-H$ |
| S-99 | $-NHCOCH_3$ | $-CH_3$ | $-CH_3$ | $-H$ |
| S-100 | 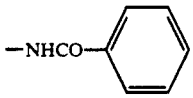 | $-CH_3$ | $-CH_3$ | $-H$ |
| S-101 | 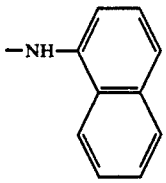 | $-CH_3$ | $-C_3H_7(i)$ | $-H$ |
| S-102 | 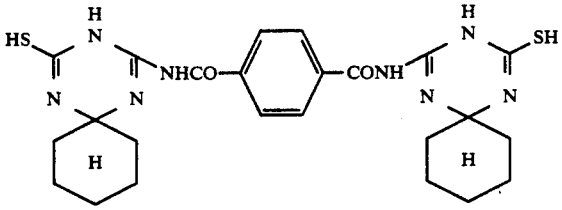 | | | |

When the invention is applied to color light-sensitive materials or the like, various dye-forming substances can be used, and the typical examples of which are dye-forming couplers.

As a yellow dye forming coupler, the known acylacetanilide couplers are advantageously used, and of which benzoylacetanilide and pyvaloylacetanilide compounds are particularly advantageous. The typical examples of the useful yellow coupler are those described in British Patent 1,077,874, Japanese Patent Examined Publication No. 40757/1970; Japanese Patent O.P.I. Publication Nos. 1031/1972, 26133/1972, 94432/1973, 87650/1975, 3631/1976, 115219/1977, 99433/1979, 133329/1979, and 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023,, 4,336,327, 4,356,258, 4,386,155, and 4,401,752, and the like.

The non-diffusible yellow coupler used in the light-sensitive material of the invention is a coupler preferably represented by the following General Formula [Y].

General Formula [Y]

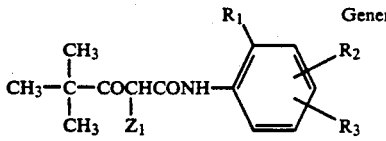

In this formula, $R_1$ represents a halogen atom, or alkoxy group; $R_2$, a hydrogen atom, halogen atom, or alkoxy group possibly having a substituent group; $R_3$, an acylamino group, alkoxycarbonyl group, alkylsulfamoyl group, arylsulfamoyl group, arylsulfonamide group, alkylureide group, arylureide group, succinimide group, alkoxy group, or aryloxy group, each possibly having a substituent group; $Z_1$, a group capable of being split off upon a coupling reaction with the oxidation product of a color developing agent.

According to the invention, the useful magenta dye image forming couplers, in addition to those of General Formula [M-I], are the couplers represented by the following General Formula [a].

General Formula [a]

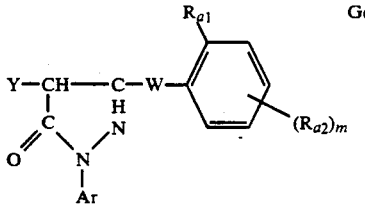

In this formula, Ar represents an aryl group; $R_{a1}$, a hydrogen atom, or substituent group; $R_{a2}$, a substituent group; Y, a hydrogen atom, or a group capable of being split off upon a reaction with the oxidation product of a color developing agent; W, —NH—, —NHCO— (N atom is bonded to the carbon atom on the pyrazolone nucleus) or —NHCONH—; m, an integer of 1 or 2.

The typical cyan dye image forming couplers are 4-equivalent and 2-equivalent phenol and naphthol couplers, and which are described in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308, and British Patent Nos. 478,991, 945,542, 1,084,480, 1,377,233, 1,388,024, and 1,543,040, Japanese Patent O.P.I. Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, 32071/1980, 146050/1984, 31953/1984, and 117249/1985.

The preferred cyan dye image forming couplers are those represented by the following General Formulas [E] and [F].

General Formula [E]

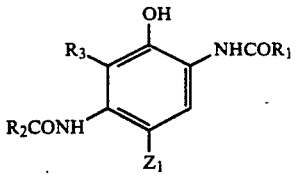

In this formula, $R_1$ represents an aryl group, cycloalkyl group, or heterocyclic group; $R_2$, an alkyl group or phenyl group; $R_3$, a hydrogen atom, halogen atom, alkyl group, or alkoxy group; $Z_1$, a hydrogen atom, halogen atom, or a group capable of being split off upon a reaction with the oxidation product of an aromatic primary amine color developing agent.

General Formula [F]

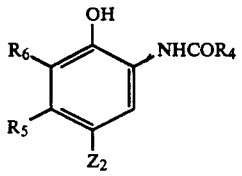

In this formula, $R_4$ represents an alkyl group (such as a methyl group, ethyl group, propyl group, butyl group, and nonyl group); $R_5$, an alkyl group (such as methyl group, and ethyl group); $R_6$, a hydrogen atom, halogen atom (such as fluorine, chlorine and bromine), alkyl group (such as methyl group, and ethyl group); $Z_2$, a hydrogen atom, halogen atom, or a group capable of being split off upon a reaction with the oxidation product of an aromatic primary amine color developing agent.

It is advantageous to use gelatin as a hydrophilic colloid in which the silver halide of the invention is dispersed. However, other types of hydrophilic colloid can be used.

The most common examples of the preferable hydrophilic colloid are gelatins such as alkali-treated gelatin and acid-treated gelatin. Other examples of the hydrophilic colloid include those comprising the above-mentioned gelatin partially replaced with derivative gelatin such as phthal gelatin, phenylcarbamoyl gelatin; and partially hydrolyzed cellulose derivative, partially hydrolyzed vinyl polyacetate, polyacrylamide, polyvinyl alcohol, polyvinyl pyrolidone, and copolymers of these vinyl compounds.

The silver halide photographic light-sensitive material of the invention can incorporate various known photographic additives. The examples of such additives include ultraviolet absorbents (such as benzophenone compounds and benzotriazole compounds), dye-image stabilizers (such as phenol compound, bisphenol compounds, hydroxychroman compounds, bisspirochroman compound, hydantonin compounds, and dialkoxybenzene compounds), anti-stain agents (such as hydroquinone derivatives), surfactants (such as sodium alkylnaphthalenesulfonate, sodium alkylbenzenesulfonate, sodium alkylsuccinate sulfonate, and polyalkylene glycol), water-soluble anti-irradiation dyes (such as azo compounds, styryl compounds, triphenylmethane compounds, oaxanol compounds, and anthraquinone compounds), hardeners (such as halogen S-triazine compounds, vinylsulfone compounds, acryloyl compounds, ethyleneimino compounds, N-methylol compounds, epoxy compounds, and water-soluble aluminum salts), layer-properties improving agents (such as glyceline, aliphatic multivalent alcohols, polymer dispersions (latex), solid or liquid paraffin, and colloidal silica), fluorescent whitening agents (such as diaminostylbene compounds), and various oil-soluble paints.

Other than the emulsion layers, the photographic layers for constituting the silver halide photographic light-sensitive material of the invention include the subbing layer, intermediate layer, yellow filter layer, ultraviolet absorbing layer, protective layer, and anti-halation layer, and each of such layers can be arbitrarily incorporated according to a specific requirement.

According to a specific requirement, the support of the silver halide photographic light-sensitive material according to the invention can be arbitrarily selected from supports made, for example, of paper, glass, cellulose acetate, cellulose nitrate, polyester, polyamide, and polystyrene; or from lamination members, i.e. lamination supports made of more than two materials, such as a lamination member made of paper and polyolefine (such as polyethylene, and polypropylene).

To improve adhesion to the silver halide emulsion layer, such a support is usually subjected to various types of surface treatment. For example, its surface is coarsened mechanically, or by using an appropriate organic solvent; or it is subjected to surface treatment such as electron impact treatment or flame treatment; or it is subjected to a subbing treatment for forming a subbing layer.

The silver halide photographic light-sensitive material of the invention can form an image when subjected to a developing process known in the photographic art.

The black-and-white developing agents useful in the invention are, for example, those described in The Theory of Photographic Process, by T. H. James, Vol. 4, pp. 291–326.

The color developing agents used, according to the invention, in the color developer include the known agents commonly used in various color photographic processes. These developing agents include aminophenol and p-phenylenediamine derivative developing agents. These compounds are stabler in the form of salt than in the free state, and, therefore, they are used in the form of hydrochloride, or sulfate. These compounds are usually used at a concentration of approx. 0.1 to 30 grams, or, preferably, approx. 1 to 15 grams per liter color developer.

The examples of the useful aminophenol based developing agent include o-aminophenol, p-aminophenol, 5-amino-2-oxytoluene, 2-amino-3-oxytoluene, and 2-oxy-3-amino-1,4-dimethylbenzene.

The particularly useful primary aromatic amine color developing agents are N,N'-dialkyl-p-phenylenediamine compounds, wherein their alkyl and phenyl groups may have arbitrary substituents. The especially advantageous examples of such compounds include N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N'-diethylaniline, and 4-amino-N-(2-methoxyethyl)-N-ethyl-3-methylaniline-p-toluene sulfonate.

In addition to the above-mentioned developing agent, to the developer used for treating the silver halide photographic light-sensitive material of the invention can be added known compounds that are the constitutes of the developer. The examples of such compounds used arbitrarily include alkali agents such as sodium hydroxide, and potassium carbonate; alkali metal sulfite, alkali metal bisulfite, alkali metal thiocyanate, alkali metal halide, benzyl alcohol; water softener, and thickener.

The temperature of developer used is not less than 15° C., or, usually, 20° to 50° C. In the case of rapid processing, the preferred temperature is not less than 30° C. The pH level of the developer is usually not lower than 7, or, most commonly, approx. 10 to 13.

In embodying the invention, when using a silver halide photographic light-sensitive material that contains high chloride silver halide emulsion as a silver halide emulsion, the preferred developer is one that virtually does not contain bromine irons.

This is because the bromine ions present significantly hinders rapid developing of the light-sensitive material. The developer that virtually does not contain bromine ions is a processing solution whose bromine ion content is not more than $1\times10^{-3}$ M.

The silver halide containing high silver chloride content can partially contain silver bromide, and silver iodide, other than silver chloride. Accordingly, if the light-sensitive material contain silver bromide, a trace amount of the bromine ions is eluted from the material into the developer. The solubility of the so-eluted bromine ions is several digits different from those of the chlorine ions and silver ions in the non-image portion, i.e. in the high chloride silver halide not developed in the developer, thereby the so-eluted bromine ions are partially substituted and retained in the silver halide color photographic light-sensitive material and are possibly transferred to a process following the developing. As mentioned above, since though in a trace amount, the bromine ions are possibly eluted, as mentioned above, into the developer once the high chloride silver halide is developed. Therefore, it is impossible to maintain the bromine ion concentration in the developer at null. According to the invention, the expression "virtually not containing bromine ions" means that the developer is not allowed to contain bromine ions other than those unavoidably contained in the developer, such as a trace amount of similar ions eluted by developing. The concentration of $1\times10^{-3}$ M is the upper allowable level of the unavoidably contained in the developer.

The silver halide photographic light-sensitive material of the invention can contain, in the hydrophilic colloid layer, the color developing agent itself, or a precursor of the agent, and can be processed in an alkali active bath. The precursor of a color developing agent is a compound that is capable of generating a color developing agent in an alkali atmosphere, and the examples of which include Schiff-base type precursors with an aromatic aldehyde derivative, multivalent metal ion complex precursors, imide phthalate derivative precursors, amide phosphate derivative precursors, sugar amine reaction product precursors, and urethane type precursors. These precursors of the aromatic primary amine color developing agents are described, for example, in U.S. Pat. Nos. 3,342,599, 2,507,114, 2,695,234, and 3,719,492, British Patent No. 803,784, Japanese Patent O.P.I. Publication Nos. 185628/1978, and 79035/1979, Research Disclosure Nos. 15159, 12146, and 13924.

These aromatic primary amine color developing agents and their precursors must added to the light-sensitive material in an amount enough, without further addition, for ensuring satisfactory coloration when the material is subjected to an activation process. The amount varies depending on the type of the light-sensitive material, and, usually, 0.1 to 5 mol, or, preferably, 0.5 to 3 mol per mol silver halide. These color developing agents or their precursors can be used either singly or in combination. Incorporating such compound into the light-sensitive material is achieved after dissolving it in an appropriate solvent such as water, methanol, ethanol, and acetone, or is effected in the form of emulsified dispersion prepared using a high boiling point organic solvent such as dibutyl phthalate, dioctyl phthalate, and tricresyl phosphate; or such a compound can be added after being impregnated into latex polymer, as described in Research Disclosure No. 14850.

Once the color developing is complete, the silver halide photographic light-sensitive material is subjected to bleaching and fixing. The bleaching may be performed at the same time as the fixing. Various compounds are used as a fixer, and those commonly used, singly or in combination, include multivalent metal compounds such as of iron (III), cobalt (III), and copper (II); and complex salts of these multivalent metal cation and organic acid, such as metal complex salts of aminopolycarboxylic acids such as ethylenediaminetetraacetic acid, nitrilotriacetic acid, N-hydroxyethylethylenediaminediacetic acid; and metal complex salts of maronic acid, tartaric acid, malic acid, diglycolic acid, and diglycolic acid; and ferricyanic salts, and bicromic acid.

A useful fixer is a soluble complexing agent that is capable of dissolving silver halide as complex salt. The examples of such a fixer include sodium thiosulfate, ammonium thiosulfate, potassium thiocyanate, thiourea, and thioether.

Once the fixing is complete, washing is usually performed. Instead of the washing, stabilizing can be performed, or both processes may be used in conjunction. Stabilizer solution used in the stabilizing can incorporate a pH adjusting agent, chelating agent, ungicide, and the like. Such arrangement is more specifically described in Japanese Patent O.P.I. Publication No. 134636/1983 and the like.

EXAMPLES

The present invention is hereunder described in more details referring to the following examples. However, these examples are possible embodiments of the invention, and by no means limit the scope of the invention.

EXAMPLE 1

Preparation of silver halide emulsion (Em-A)

The amount of additive used for preparing emulsion is hereunder means an amount per mol silver halide, unless otherwise specified.

Silver nitrate solution and potassium bromide solution were added to aqueous inactive gelatin solution in 150 minutes according to the double-jet precipitation process, and in this course, the temperature was kept at 50° C., and the pAg level was kept at 7.5.

Next, based on conventional methods, desalination and washing were performed to obtain Em-A. Em-A comprised tetradecahedral silver bromide grains whose average size being 0.6 μm, variation coefficient being 10.0%.

Preparation of silver halide emulsion (Em-B)

Em-B was prepared under conditions identical to those of Em-A, except that during the formation of silver halide grains, $3\times10^{-4}$ mol of $K_2IrCl_6$ was added.

To each of these seed emulsions was added 4.5 mg of sodium thiosulfate to perform chemical sensitization. The chemical sensitization was performed at 60° C. in a period for optimizing sensitometric performance (sensitivity, and gradation), wherein 2 g of 4-hydroxy-6-methyl-1,3,3a-7-tetrazaindene as a stabilizer was added, and then, the temperature was decreased to terminate the chemical sensitization. In this course, 10 minutes before the termination of the chemical sensitization was added sensitizing dye (D-1), and 5 minutes before the chemical sensitization was added inorganic sulfur (Wako Junyaku) in an amount specified in Table 1. Thus each of Em-1 through Em-5 was obtained.

Preparation of coated sample

To each of the so-prepared emulsions were added, as a coating auxiliary, sodium dodecylbenzenesulfonate, gelatin, and 10 mg of hardener [H-1] per gram gelatin; and magenta coupler represented of the invention represented by General Formula [M-I] (or Comparative Coupler [A]) (as specified in Table 1) as dissolved in dibutylphthalate. The resultant emulsion was applied to and dried on a paper support coated with a polyethylene resin that contained titanium oxide.

In preparing the samples, conditions were adjusted so that the amount added of the magenta coupler of the invention was 40 mol % per mol silver halide; the silver coating weight as converted into metal silver was 0.2 g/m$^2$; for the samples using Comparative Magenta Coupler [A], the amount added of the coupler was 20 mol % per mol silver, and the coating silver weight as converted into metal silver was 0.4 g/m$^2$.

With each sample, on the emulsion layer was formed a protective layer of gelatin at a rate of 2.0 g/m$^2$. Thus Sample Nos. 1 through 12 were prepared.

Each sample was exposed using the sensitometer Model KS-7 (Konica Corporation), and then, treated according to the developing process A specified below. After the process, each sample was subjected to sensitometric evaluation using the photographic densitometer Model PDA-65 (Konica Corporation).

[Color developing process A]

| | | |
|---|---|---|
| [1] Color developing | 38° C. | 3 min. 30 sec. |
| [2] Bleach-fixing | 33° C. | 1 min. 30 sec. |
| [3] Washing | 25–30° C. | 3 min. |
| [4] Drying | 75–80° C. | approx. 2 min. |

[Processing solution compositions]

(Color developer)

| | |
|---|---|
| Benzyl alcohol | 15 ml |
| Ethylen glycol | 15 ml |
| Potassium sulfite | 2.0 g |
| Potassium bromide | 1.3 g |
| Sodium chloride | 0.2 g |
| Potassium carbonate | 30.0 g |
| Hydroxyamine sulfate | 3.0 g |
| Polyphosphoric acid (TPPS) | 2.5 g |
| 3-methyl-4-amino-N-ethyl-N-(β-methanesulfonamidoethyl)aniline sulfate | 5.5 g |
| Fluorescent whitening agent (4,4'-diaminostylbenesulfonate derivative) | 1.0 g |
| Potassium hydroxide | 2.0 g |

Water was added to 1 liter, and the pH was adjusted to 10.20.

(Bleach-fixer)

| | |
|---|---|
| Ferric ammonium ethylenediaminetetraacetate dihydrate | 60 g |

-continued

| | |
|---|---|
| Ammonium thiosulfate ethylenediaminetetraacetate (70% aqueous solution) | 100 ml |
| Ammonium sulfite (40% aqueous solution) | 27.5 ml |
| The pH was adjusted to 7.1 with potassium carbonate or glacial acetic acid, and water was added to 1 liter. | |

The samples undergone the above-mentioned process were subjected to a series of tests below for evaluating Y-stain. (Y-stain test)

Light-fastness

The Y-stain (difference in blue density D, before and after the test) on the non-colored portion was measured on each sample exposed to sun light for 200 hours, as placed on the under-glass outdoor exposure table.

Moisture-heat fastness

The Y-stain (difference in blue density D, before and after the test) on the non-colored portion was measured on each sample that was allowed to stand for 14 days under high temperature, high moisture atmosphere of 65° C. and 80RH.

Next, using the so-treated sample, the exposure illumination dependency of the gradation was evaluated in a manner described below.

Two pieces of each sample were exposed through an optical wedge, respectively, for 0.05 seconds (under high illumination) and for 10 seconds (under low illumination), and then, each piece was subjected to a color developing process same as that was used in sensitivity measurement. The so-treated samples were subjected to sensitometry, thereby gradation fluctuation ($\Delta\bar{r}$) of each sample was evaluated. Table 1 summarizes the evaluation results.

In this table, $\bar{r}$ represents a value of gradation; $\Delta\bar{r}$ represents a difference from $\bar{r}$ obtained by high illumination exposure and $\bar{r}$ obtained by low illumination exposure, and smaller value means a better light-sensitive material whose resultant gradation is less dependent on exposure illumination.

(3) Addition of inorganic sulfur decreases fogs, and, also improves $\Delta\bar{r}$.

EXAMPLE 2

Preparation of Em-C, and D

Silver nitrate solution and sodium chloride solution were added to aqueous inactive gelatin solution according to the double-jet precipitation process, and in this course, the temperature was kept at 45° C.; the pH level was kept at 6.0; and the pAg level at 7.3.

Next, based on conventional methods, desalination and washing were performed to obtain Em-C that comprises cubic silver chloride grains whose average size being 0.45 μm, variation coefficient being 6.8%.

Em-D was prepared under conditions identical to those of Em-C, except that during the formation of silver halide grains, $1.5\times10^{-6}$ mol of $K_2IrCl_6$ was added.

To each of these seed emulsions was added a chemical sensitizer specified in Table 2. Five minutes later, $4\times10^{-4}$ mol of Sensitizing Dye [D-2] was added, thus each emulsion was subjected to chemical sensitization.

The chemical sensitization was performed at 57° C. in a period for optimizing sensitometric performance, wherein a compound specified in Table 2 was added to each emulsion, and then, the temperature was decreased to terminate the chemical sensitization.

Additionally, one minute after the addition of the chemical sensitizer, inorganic sulfur was added as specified in Table 2 to obtain Em-6 through Em-19.

Furthermore, Em-20 through Em-24 were prepared in a manner identical to that of Em-19, except that [S-8], [S-12], [S-39] or [S-42] was added at a rate of $2\times10^{-4}$ mol.

Preparation of coated sample

To each of the so-prepared emulsions were added 0.4 mol of a magenta coupler specified in Table 2 and dissolved in dibutyl phthalate; sodium dodecylbenzenesulfonate; gelatin; and 10 mg of [H-1] per 1 gram of gelatin; and an additive specified in Table 2. Then each of the so-obtained emulsions was applied to and dried on a polyethylene-coated paper support, so that the coating silver weight was 0.2 g/m²; and the coating gelatin weight was 4;0 g/m². Next, on the emulsion layer was formed a protective layer by applying and drying gelatin thereon at a rate of 3.0 g/m², thus Sample Nos. 13 through 39 were obtained.

TABLE 1

| Sample No. | Emulsion No. | Seed emulsion | Inorganic sulfur (amount added, mg/AgX mol) | Coupler | Fog | Y-stain: Light fastness | Y-stain: Moisture/heat fastness | Illumination dependency of gradation $\Delta\bar{r}$ | Remarks |
|---|---|---|---|---|---|---|---|---|---|
| 1 | Em-1 | Em-A | — | Comparative coupler [A] | 0.03 | 0.42 | 0.45 | 0.12 | |
| 2 | Em-1 | Em-A | — | Comparative coupler [B] | 0.04 | 0.44 | 0.43 | 0.08 | |
| 3 | Em-2 | Em-A | 0.3 | Comparative coupler [B] | 0.04 | 0.43 | 0.43 | 0.10 | Relative sensitivity, 44% of No. 4 |
| 4 | Em-1 | Em-A | — | [1] | 0.08 | 0.06 | 0.09 | 0.53 | |
| 5 | Em-3 | Em-B | — | [1] | 0.08 | 0.07 | 0.08 | 0.24 | |
| 6 | Em-2 | Em-A | 0.3 | [1] | 0.05 | 0.07 | 0.08 | 0.20 | |
| 7 | Em-3 | Em-A | 0.02 | [1] | 0.06 | 0.07 | 0.08 | 0.23 | |
| 8 | Em-4 | Em-A | 0.2 | [1] | 0.05 | 0.07 | 0.08 | 0.18 | |
| 9 | Em-5 | Em-A | 1.5 | [1] | 0.06 | 0.08 | 0.08 | 0.19 | |
| 10 | Em-2 | Em-A | 0.3 | [18] | 0.06 | 0.07 | 0.07 | 0.17 | |
| 11 | Em-2 | Em-A | 0.3 | [31] | 0.05 | 0.08 | 0.09 | 0.19 | |
| 12 | Em-2 | Em-A | 0.3 | [61] | 0.05 | 0.08 | 0.08 | 0.19 | |

It can be understood from Table 1 that:

(1) The couplers of the invention are superior to comparative couplers, in that the resultant Y-stain is significantly limited; while these couplers result in increased fog and deteriorated $\Delta\bar{r}$;

(2) Addition of iridum considerable improves $\Delta\bar{r}$, while incurring significant desensitization;

Each sample was exposed using the sensitometer Model KS-7, and then, treated according to developing process B specified below. After the process, each sample was subjected to sensitometric evaluation using the photographic densitometer Model PDA-65.

The exposure illumination dependency of gradation of each sample was evaluated in a manner same as that of Example 1.

[Color developing process B]

| | | |
|---|---|---|
| Color developing | 35 ± 0.3° C. | 45 sec. |
| Bleach-fixing | 35 ± 0.5° C. | 45 sec. |
| Stabilizing | 30–34° C. | 90 sec. |
| Drying | 60–80° C. | 60 sec. |

[Color developer]

| | |
|---|---|
| Pure water | 800 ml |
| Triethanolamine | 10 g |
| N,N-diethylhydroxylamine | 10 g |
| Potassium chloride | 2 g |
| Potassium sulfite | 0.3 g |
| 1-hydroxyethyledene-1,1-diphosphonate | 1.0 g |
| Ethylenediamine tetraacetic acid | 1.0 g |
| Disodium catechol-3,5-disulfonate | 1.0 g |

-continued

| | |
|---|---|
| N-ethyl-N-β-methanesulfonamidoethyl-3-methyl-4-aminaniline sulfate | 4.5 g |
| Fluorescent whitening agent (4,4'-diaminostylbene sulfonate derivative) | 1.0 g |
| Water was added to 1 liter, and then the pH was adjusted to 10.10. | |
| [Bleach-fixer] | |
| Ferric ammonium ethylenediaminetetraacetate dihydrate | 60 g |
| Ethylenediamine tetraacetic acid | 3 g |
| Ammonium thiosulfate (70% aqueous solution) | 100 ml |
| Ammonium sulfite (40% aqueous solution) | 27.5 ml |
| The pH was adjusted to 6.2 using potassium carbonate or glacial acetic acid, and water was added to 1 liter. | |
| [Stabilizer] | |
| 5-chloro-2-methyl-4-isothiazoline-3-one | 1.0 g |
| Ethylene glycol | 1.0 g |
| 1-hydroxyethylidene-,1-diphosphonic acid | 2.0 g |
| Ethylenediaminetetraacetic acid | 1.0 g |
| Ammonium hydroxide (20% solution) | 3.0 g |
| Ammonium sulfite | 3.0 g |
| Fluorescent whitening agent (4,4'-diaminostylbene sulfonate derivative) | 1.5 g |
| Water was added to 1 liter, and the pH was adjusted to 7.0 using sulfuric acid or potassium hydroxide. | |

TABLE 2

| Sample No. | Emulsion (seed emulsion) | Additive added before chemical sensitization (mol/AgX mol) [added 1 min. preceding chemical sensitizer] | Chemical sensitizer (mg/AgX mol) | Inorganic sulfur (mg/AgX) | Additive added at termination of chemical sensitization (mol/AgX mol) | Compounded added at preparation of coating solution (g/AgX mol) | Coupler tivity | Sensitometry Sensi- | Fog | $\Delta\bar{r}$ | Illumination dependency of gradation |
|---|---|---|---|---|---|---|---|---|---|---|---|
| 13 | Em-6 (Em-C) | — | Sodium thiosulfate (2.5) | — | S-16 ($2 \times 10^{-3}$) | — | [21] | 100 | | 0.18 | +0.62 |
| 14 | Em-7 (Em-C) | — | Sodium thiosulfate (2.5) | 0.2 | S-16 ($2 \times 10^{-3}$) | — | [21] | 102 | | 0.11 | +0.35 |
| 15 | Em-8 (Em-C) | — | Soium thiosulfate (2.5) | 0.2 | S-3 ($1 \times 10^{-3}$) | — | [21] | 108 | | 0.08 | +034 |
| 16 | Em-9 (Em-C) | — | Sodium thiosulfate (2.5) | 0.2 | S-11 ($1 \times 10^{-3}$) | — | [21] | 113 | | 0.07 | +0.36 |
| 17 | Em-10 (Em-C) | — | Sodium thiosulfate (2.5) | 0.2 | S-19 ($1 \times 10^{-3}$) | — | [21] | 115 | | 0.07 | +0.35 |
| 18 | Em-11 (Em-C) | — | Sodium thiosulfate (2.5) | 0.2 | S-39 ($1 \times 10^{-3}$) | — | [21] | 117 | | 0.07 | +0.33 |
| 19 | Em-12 (Em-C) | — | Sodium thiosulfate (2.5) | 0.2 | S-42 ($1 \times 10^{-3}$) | — | [21] | 116 | | 0.07 | +0.33 |
| 20 | Em-13 (Em-C) | — | Sodium thiosulfate (2.5) | 0.2 | S-49 ($1 \times 10^{-3}$) | — | [21] | 114 | | 0.07 | +0.35 |
| 21 | Em-14 (Em-C) | — | Sodium thiosulfate (2.5) | 0.2 | S-73 ($1 \times 10^{-3}$) | — | [21] | 114 | | 0.07 | +0.35 |
| 22 | Em-15 (Em-C) | — | Sodium thiosulfate (2.5) | 0.2 | S-37 ($5 \times 10^{-4}$) S-43 ($5 \times 10^{-4}$) | — | [21] | 115 | | 0.07 | +0.34 |
| 23 | Em-16 (Em-C) | — | Sodium thiosulfate (2.5) | 0.2 | S-36 ($1 \times 10^{-3}$) | — | [21] | 115 | | 0.07 | +0.34 |
| 24 | Em-17 (Em-C) | — | Chloroauric acid (1.5) | 0.2 | S-36 ($1 \times 10^{-3}$) | — | [21] | 167 | | 0.06 | +0.26 |
| 25 | Em-18 (Em-C) | — | Chloroauric acid (20) | 0.2 | S-36 ($1 \times 10^{-3}$) | — | [21] | 173 | | 0.06 | +0.26 |
| 26 | Em-19 (Em-C) | — | Sodium thiosulfate (2) Chloroauric acid (4) | 0.2 | S-36 ($1 \times 10^{-3}$) | — | [21] | 177 | | 0.06 | +0.27 |
| 27 | Em-20 (Em-C) | S-8 ($2 \times 10^{-4}$) | Sodium thiosulfate (2) Chloroauric acid (4) | 0.2 | S-36 ($1 \times 10^{-3}$) | — | [21] | 175 | | 0.05 | +0.22 |
| 28 | Em-21 (Em-C) | S-12 ($2 \times 10^{-4}$) | Sodium thiosulfate (2) Chloroauric acid (4) | 0.2 | S-36 ($1 \times 10^{-3}$) | — | [21] | 170 | | 0.05 | +0.19 |
| 29 | Em-22 (Em-C) | S-39 ($2 \times 10^{-4}$) | Sodium thiosulfate (2) Chloroauric acid (4) | 0.2 | S-36 ($1 \times 10^{-3}$) | — | [21] | 186 | | 0.05 | +0.21 |
| 30 | Em-23 (Em-C) | S-42 ($2 \times 10^{-4}$) | Sodium thiosulfate (2) | 0.2 | S-36 ($1 \times 10^{-3}$) | — | [21] | 173 | | 0.05 | +0.20 |

TABLE 2-continued

| Sample No. | Emulsion (seed emulsion) | Additive added before chemical sensitization (mol/AgX mol) [added 1 min. preceding chemical sensitizer] | Chemical sensitizer (mg/AgX mol) | Inorganic sulfur (mg/AgX) | Additive added at termination of chemical sensitization (mol/AgX mol) | Compounded added at preparation of coating solution (g/AgX mol) | Coupler tivity | Sensitometry Sensi- | Fog | $\Delta\bar{r}$ | Illumination dependency of gradation |
|---|---|---|---|---|---|---|---|---|---|---|---|
| | | | Chloroauric acid (4) | | | | | | | | |
| 31 | Em-23 | S-42 ($2 \times 10^{-4}$) | Sodium thiosulfate (2) Chloroauric acid (4) | 0.2 | S-36 ($1 \times 10^{-3}$) | Potassium bromide (0.2) | [21] | 191 | 0.05 | | +0.21 |
| 32 | Em-23 | S-42 ($2 \times 10^{-4}$) | Sodium thiosulfate (2) Chloroauric acid (4) | 0.2 | S-36 ($1 \times 10^{-3}$) | Potassium bromide (1.5) | [21] | 198 | 0.05 | | +0.19 |
| 33 | Em-23 | S-42 ($2 \times 10^{-4}$) | Sodium thiosulfate (2) Chloroauric acid (4) | 0.2 | S-36 ($1 \times 10^{-3}$) | Silver bromide (0.2) | [21] | 188 | 0.04 | | +0.16 |
| 34 | Em-23 | S-42 ($2 \times 10^{-4}$) | Sodium thiosulfate (2) Chloroauric acid (4) | 0.2 | S-36 ($1 \times 10^{-3}$) | Potassium nitrate (2.0) | [21] | 190 | 0.04 | | +0.15 |
| 35 | Em-24 (Em-D) | S-42 ($2 \times 10^{-4}$) | Sodium thiosulfate (2) Chloroauric acid (4) | 0.2 | S-36 ($1 \times 10^{-3}$) | — | [21] | 169 | 0.05 | | +0.10 |
| 36 | Em-24 | S-42 ($2 \times 10^{-4}$) | Sodium thiosulfate (2) Chloroauric acid (4) | 0.2 | S-36 ($1 \times 10^{-3}$) | — | [32] | 165 | 0.04 | | +0.11 |
| 37 | Em-24 | S-42 ($2 \times 10^{-4}$) | Sodium thiosulfate (2) Chloroauric acid (4) | 0.2 | S-36 ($1 \times 10^{-3}$) | — | [37] | 166 | 0.04 | | +0.10 |
| 38 | Em-24 | S-42 ($2 \times 10^{-4}$) | Sodium thiosulfate (2) Chloroauric acid (4) | 0.2 | S-36 ($1 \times 10^{-3}$) | — | [63] | 170 | 0.05 | | +0.11 |
| 39 | Em-24 | S-42 ($2 \times 10^{-4}$) | Sodium thiosulfate (2) Chloroauric acid (4) | 0.2 | S-36 ($1 \times 10^{-3}$) | — | [65] | 164 | 0.04 | | +0.12 |

As apparent from Table 2, the effect of the invention is sufficiently exhibited even with a silver chloride emulsion, whereby the invention provides a light-sensitive material of significantly improved rapid processability The effect of the invention is further enhanced by adding an iridium compound, gold compound, and inhibitor.

EXAMPLE 3

The seven layers specified below were sequentially formed by coating on a polyethylene-coated paper support to prepare a multi-layer silver halide photographic light-sensitive material. The amounts added specified below are amounts per square meter, unless otherwise specified.

Layer 1

Layer comprising 1.2 g of gelatin, 0.33 g (as converted into metal silver, hereinafter applicable) of blue-sensitive silver chloro-bromide emulsion (average grain size, 0.8 lm; silver bromide content, 0.3 mol %); and dioctyl phthalate (hereinafter referred to as DOP) dissolving 0.9 g of yellow coupler YC-1, and 0.015 g of 2,5-di-t-octylhydroquinone (HQ-1).

Layer 2

Layer comprising 0.7 g of gelatin; and DOP dissolving 0.06 g of HQ-1.

Layer 3

Layer comprising 1.25 g of gelatin, 0.18 g of green-sensitive silver chloro-bromide emulsion Em-24; and DOP dissolving 0.53 g of magenta coupler 34, 0.2 g of [A-1], 0.4 g of [A-2], and 0.015 g of HQ-1.

Layer 4

Layer comprising 1.3 g of gelatin; and DOP dissolving 0.08 g of HQ-1, and 0.5 g of ultraviolet absorbent (UV-1).

Layer 5

Layer comprising 1.4 g of gelatin, 0.24 g of red-sensitive silver chloro-bromide emulsion (average grain size, 0.5 lm; silver bromide content, 0.1 mol %); and DOP dissolving 0.3 g of cyan coupler CC-1, 0.2 g of CC-2, and 0.02 g of HQ-1.

Layer 6

Layer comprising 1.0 g of gelatin; and DOP dissolving 0.032 g of HQ-1, and 0.2 g of UV-1.

Layer 7

Layer comprising 0.003 g of silicon dioxide, and 0.5 g of gelatin.

As a hardener, 5 mg of [H-1] was added per gram gelatin, and 10 mg of [H-2] was added per gram gelatin.

Thus, multi-layer silver halide color light-sensitive material No. 40 was prepared. Next, sample Nos. 41 through 43 were prepared by incorporating modification specified below.

Sample No. 41 Green-sensitive emulsion Em-24 in layer 3 of Sample No. 40 was replaced with Em-25.

Where Em-25 was an emulsion identical to Em-24, except that inorganic sulfur was not added in chemical sensitization.

Sample No. 42 Magenta coupler 34 in layer 3 of Sample No. 40 was replaced with comparative coupler [C], wherein coating silver weight was changed to 0.35 g.

Sample No. 43 0.3 mg of [S-42] was added to Layer 2 of Sample No. 40, and 0.2 mg of [S-42] was added to layer 4.

Sample Nos. 40 through 43 were evaluated using the method in Example 2. The evaluation results of layer 3 are summarized in Table 3.

TABLE 3

| Sample No. | Emulsion of layer 3 (addition of inorganic sulfur, mg/mol AgX) | Coupler in layer 3 | Compound added to intermediate layer | Y-stain Light-fastness | Y-stain Moisture/heat fastness | Fog | Illumination dependency of gradation $\Delta\bar{r}$ |
|---|---|---|---|---|---|---|---|
| 41 | Em-25 (0.2) | 34 | — | 0.16 | 0.46 | 0.03 | +0.13 |
| 42 | Em-24 (—) | Comparative coupler [C] | — | 0.06 | 0.08 | 0.11 | +0.57 |
| 40 | Em-24 (0.2) | 34 | — | 0.06 | 0.07 | 0.04 | +0.11 |
| 43 | Em-24 | 34 | S-42 in Layers 2 and 4 | 0.06 | 0.07 | 0.03 | +0.10 |

It is apparent from the results in Table 'that the silver halide photographic light-sensitive material of the invention minimizes the occurrence of Y-stain, without jeopardizing fog, and illumination dependency of gradation.

D-1

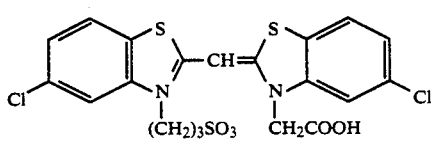

D-2

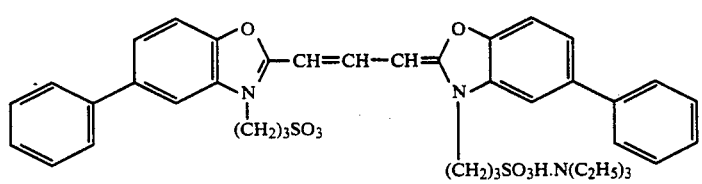

Comparative coupler [A]

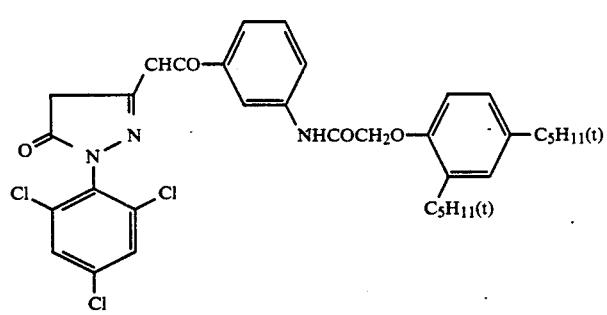

Comparative coupler (B)

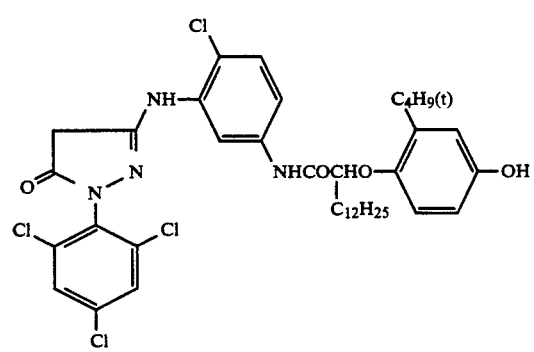

-continued
Comparative coupler (C)
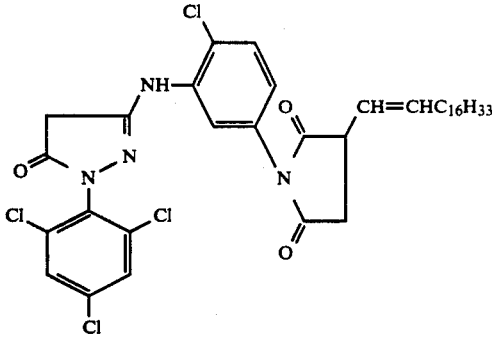
[A-1]
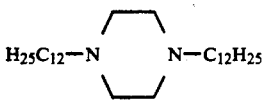
[A-2]
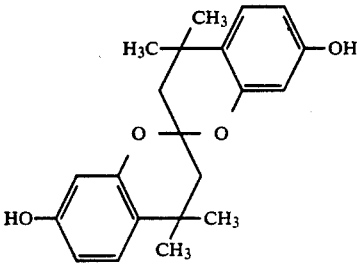
[YC-1]
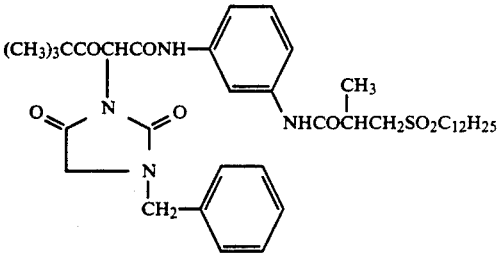
[CC-1]
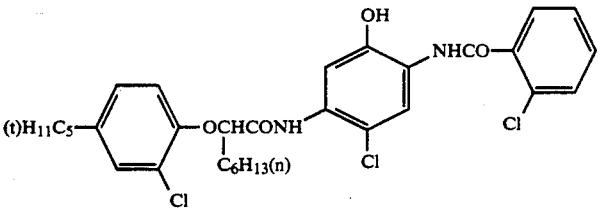
[CC-2]
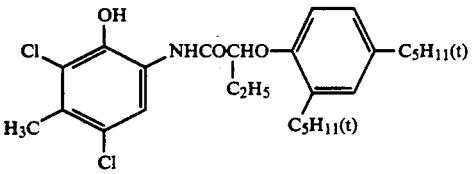
[UV-1]
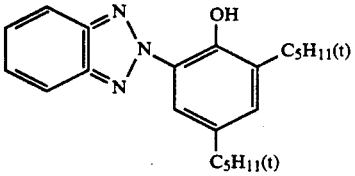

-continued

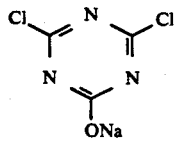

[H-1]

$C(CH_2SO_2CH{=}CH_2)_4$

[H-2]

What is claimed is:

1. A light-sensitive silver halide photographic material comprising a support and provided thereon at least one silver halide emulsion layer containing a magenta dye-forming coupler represented by formula M-I;

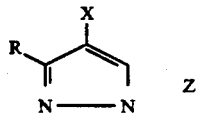

M-1 wherein Z represents a group of non-metal atoms necessary to complete a nitrogen-containing heterocyclic ring which may have a substituent; X represents a hydrogen atom or a substituent capable of being split off upon reaction with an oxidation product of a color developing agent; and R represents a hydrogen atom or a substituent, wherein an elementary sulfur has been added to said silver halide emulsion at an arbitrary timing before formation of said silver halide emulsion layer on said support; and wherein the photographic material contains a nitrogen-containing heterocyclic compound having a solubility product relative to silver ion not larger than $1\times10^{-10}$.

2. The light-sensitive silver halide photographic material of claim 1, wherein said sulfur is α-sulfur.

3. The light-sensitive silver halide photographic material of claim 1, wherein said sulfur has been added in an amount of $10^{-5}$ mg to 10 mg per 1 mol of silver halide.

4. The light-sensitive silver halide photographic material of claim 1, wherein said sulfur has been added during a period from the commencement of the chemical ripening to the completion thereof.

5. The light-sensitive silver halide photographic material of claim 1, wherein said substituent R in formula M-I is selected from the group consisting of a halogen atom, an alkyl group, a cycloalkyl group, an alkenyl group, an cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residua group, a bridged hydrocarbon compound residual group, an alkoxY group, an aryloxy group, a heterocyclic oxy group, a siloxy group, an acyloxy group, a carbamoyloxy group, an amino group, an alkylamino group, an anilino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocycic thio group.

6. The light-sensitive silver halide photographic material of claim 1, wherein said substituent R in formula M-I is a secondary or tertiary alkyl group 7. The light-sensitive silver halide photographic material of claim 1, wherein X in formula M-I is selected from the group consisting of a hydrogen atom, a halogen atom and an organic group having a carbon atom, an oxygen atom, a sulfur atom, a nitrogen atom or phosphorus atom through which said organic group is connected with the remainder of the compound.

8. The light-sensitive silver halide photographic material of claim 1, wherein X in formua M-I is selected from the group consisting of a halogen atom, an alkoxy group, an aryloxy group, a heterocyclic oxy group, an acyloxy group, a sulfonyloxy group, an alkoxycabonyloxy group, an aryloxycarbonyloxy group, an alkyloxalyloxy group, an akoxyoxalyloxy group, an alkylthio group, an arylthio group, a heterocyclicthio group, an alkyloxythiocarbonylthio group, an acylamino group, a sulfonanide group, a nitrogen-containing heterocyclic group, an alkyloxycarbonylamino group, an aryoxycarbonylamino group, a carboxyl group and a group represented by the following formula,

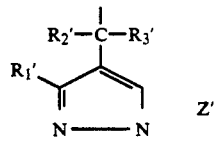

wherein $R_1'$ is defined to be the same as R, Z' is defined to be the same as Z, and $R_2'$ and $R_3'$ are independently selected from the group consisting of a hydrogen atom, an aryl group, an alkyl group and a heterocyclic group.

9. The light-sensitive silver halide photographic material of claim 1, wherein said nitrogen-containing heterocyclic ring in formua M-I is selected from the group consisting of a pyrazole ring, an imidazole ring, a triazole ring and a tetrazole ring.

10. The light-sensitive silver halide photographic material of claim 1, wherein said magenta dye forming coupler is selected from a compound represented by formula [VII];

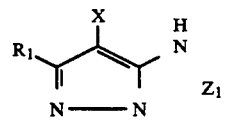

[VIII]

wherein R', X and $Z_1$ are defined to be the same meanings as R, X and Z in formula M-I, respectively.

11. The light-sensitive silver halide photographic material of claim 10, wherein said substituent $R_1$ in formula [VII] is a secondary or tertiary alkyl group.

12. The light-sensitive silver halide photographic material of claim 1, wherein said magenta dye forming coupler is a compound represented by formula [II];

[II]

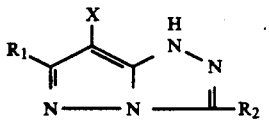

wherein the above formula $R_1$ and $R_2$ are respectively defined to be the same as R in formula M-I and X is defined to be the same as in formula M-I.

13. The light-sensitive silver halide photographic material of claim 12, wherein said substituent $R_1$ in formula [II] is a secondary or tertiary alkyl group.

14. The light-sensitive silver halide photographic material of claim 1, wherein said magenta dye forming coupler is selected from a compound represented by formulas [III] to [VII];

[III]

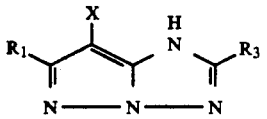

[IV]

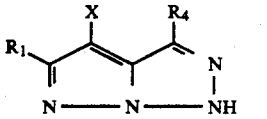

[V]

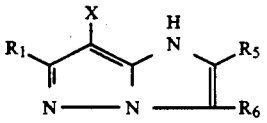

[VI]

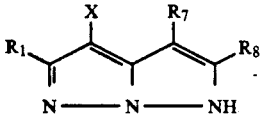

[VII]

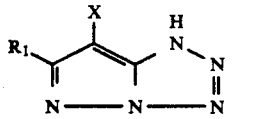

wherein in the above formulas $R_1$ and $R_3$ to $R_8$ are respectively defined to be the same as R in formula M-I and X is defined to be the same as X in formula M-I.

15. The light-sensitive silver halide photographic material of claim 14, wherein said substituent $R_1$ in formulas [III] to [VII] is a secondary or tertiary alkyl group.

16. The light-sensitive silver halide photographic material of claim 1, wherein the silver halide emulsion comprises silver halide grains having a silver chloride content of not less than 80 mol %.

17. The light-sensitive silver halide photographic material of claim 1, wherein the silver halide emulsion layer further contains a noble metal compound.

18. The light-sensitive silver halide photographic material of claim 1, wherein the nitrogen-containing heterocyclic compound is a purine derivative or a mercapto compound represented by the following Formula II:

$$Z_0\text{—SM} \qquad \text{II}$$

$Z_0$ represents a heterocyclic residue; and M represents hydrogen, an alkali metal, or ammonium.

19. The light-sensitive silver halide photographic material of claim 18, wherein the heterocyclic unit of the nitrogen-containing heterocyclic compound is imidazole, triazole or tetrazole.

20. The light-sensitive silver halide photographic material of claim 18, wherein the nitrogen-containing heterocyclic compound is a mercapto compound.

21. The light-sensitive silver halide photographic material comprising a support and provided thereon at least one silver halide emulsion layer containing a magenta dye-forming coupler represented by formula M-I;

M-1

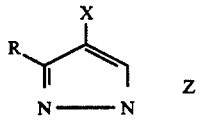

wherein Z represents a group of non-metal atoms necessary to complete a nitrogen-containing heterocyclic ring which may have a substituent; X represents a hydrogen atom or a substituent capable of being split off upon reaction with an oxidation product of a color developing agent; and R represents a hydrogen atom or a substituent, wherein an elementary sulfur has been added to said silver halide emulsion at an arbitrary timing before formation of said silver halide emulsion layer on said support.

* * * * *

UNITED STATES PATENT AND TRADEMARK OFFICE

CERTIFICATE OF CORRECTION

PATENT NO. : 5,192,652

DATED : March 09, 1993

INVENTOR(S) : Makoto Kajiwara et al.

It is certified that error appears in the above-indentified patent and that said Letters Patent is hereby corrected as shown below:

The formula M-I change " 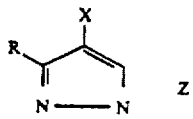 " which appears at column 3, lines 46-50; column 5, lines 20-24; in claim 1, column 61, lines 16-20; and claim 21, column 64, lines 34-37 to -- 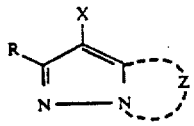 --.

The formula " 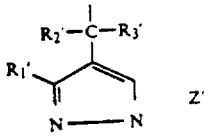 " which appears in the specification at column 6, line 60-65; and in claim 8, column 62, lines 32-37, to -- 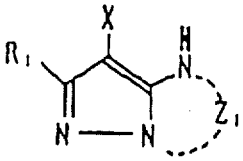 --.

UNITED STATES PATENT AND TRADEMARK OFFICE

CERTIFICATE OF CORRECTION

PATENT NO. : 5,192,652

DATED : March 09, 1993

INVENTOR(S) : Makoto Kajiwara et al.

It is certified that error appears in the above-indentified patent and that said Letters Patent is hereby corrected as shown below:

The formula "VIII" which appears in the specification at column 7, lines 60-64, and also in claim 10, column 62, lines 55-59, change " 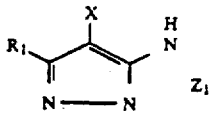 " to -- 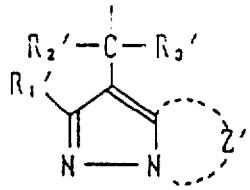 --.

Claim 5, column 61, line 53, change "residua" to --residual--.

Claim 5, column 61, line 54, change "alkoxY" to --alkoxy--.

Claim 8, column 62, line 19, change "formua" to --formula--.

Claim 8, column 62, lines 22-23, change "alkoxycabonyloxy" to --alkoxycarbonyloxy--.

Claim 8, column 62, line 27, change "sulfonanide" to --sulfonamide--.

Claim 8, column 62, line 29, change "aryoxycarbonylamino" to --aryloxycarbonylamino--.

UNITED STATES PATENT AND TRADEMARK OFFICE

CERTIFICATE OF CORRECTION

PATENT NO. : 5,192,652

DATED : March 09, 1993

INVENTOR(S) : Makoto Kajiwara et al.

It is certified that error appears in the above-indentified patent and that said Letters Patent is hereby corrected as shown below:

Claim 12, column 63, line 8, after "wherein", insert --in--.

Claim 18, column 64, line 18, before "$Z_0$" insert --wherein--.

Signed and Sealed this

Tenth Day of May, 1994

Bruce Lehman

BRUCE LEHMAN

*Commissioner of Patents and Trademarks*

*Attest:*

*Attesting Officer*

UNITED STATES PATENT AND TRADEMARK OFFICE

CERTIFICATE OF CORRECTION

PATENT NO. : 5,192,652

DATED : March 9, 1993

INVENTOR(S) : Makoto Kajiwara et al.

It is certified that error appears in the above-indentified patent and that said Letters Patent is hereby corrected as shown below:

Claim 5, column 61, line 53, change "residua" to --residual--.

Claim 5, column 61, line 54, change "alkoxY" to --alkoxy--.

Claim 8, column 62, line 19, change "formua" to --formula--.

Claim 8, column 62, lines 22-23, change "alkoxycabonyloxy" to --alkoxycarbonyloxy--.

Claim 8, column 62, line 27, change "sulfonanide" to --sulfonamide--.

Claim 8, column 62, line 29, change "aryoxycarbonylamino" to --aryloxycarbonylamino--.

Claim 12, column 63, line 8, after "wherein", insert --in--.

Claim 18, column 64, line 18, before "$Z_0$" insert --wherein--.

UNITED STATES PATENT AND TRADEMARK OFFICE

CERTIFICATE OF CORRECTION

PATENT NO. : 5,192,652

DATED : March 9, 1993

INVENTOR(S) : Makoto Kajiwara et al.

It is certified that error appears in the above-indentified patent and that said Letters Patent is hereby corrected as shown below:

The formula M-I change " 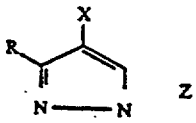 " which appears in the at column 3, lines 46-50; column 5, lines 20-24; in claim 1, column 61, lines 16-20; and claim 21, column 64, lines 34-37 to -- 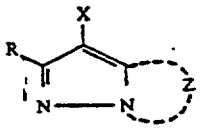 --.

The formula " 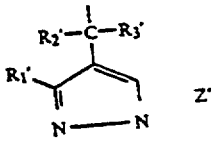 " which appears in the at column 6, line 60-65; and in claim 8, column 62, lines 32-37, to -- 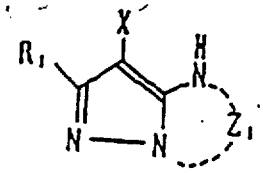 --.

UNITED STATES PATENT AND TRADEMARK OFFICE

CERTIFICATE OF CORRECTION

PATENT NO. : 5,192,652

DATED : March 9, 1993

INVENTOR(S) : Makoto Kajiwara et al.

It is certified that error appears in the above-indentified patent and that said Letters Patent is hereby corrected as shown below:

The formula "VIII" which appears in column 7, lines 60-64, and also in claim 10, column 62, lines 55-59, change " 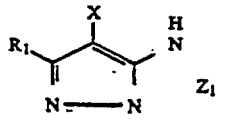 " to -- 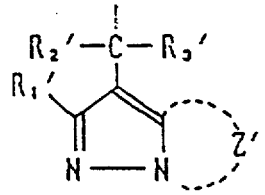 --.

On title page, item [73] Assignee, "Konica Corporation" change "Kanagawa, Japan" to --Tokyo, Japan--.

Signed and Sealed this

Twenty-ninth Day of November, 1994

*Attest:*

*Attesting Officer*

BRUCE LEHMAN

*Commissioner of Patents and Trademarks*